US007644919B2

(12) United States Patent
Sato

(10) Patent No.: US 7,644,919 B2
(45) Date of Patent: Jan. 12, 2010

(54) SHEET PROCESSING APPARATUS AND SHEET BUNDLE ALIGNMENT METHOD

(75) Inventor: Ryuichi Sato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/545,474

(22) Filed: Oct. 11, 2006

(65) Prior Publication Data

US 2007/0029724 A1 Feb. 8, 2007

Related U.S. Application Data

(62) Division of application No. 10/654,941, filed on Sep. 5, 2003, now abandoned.

(30) Foreign Application Priority Data

Mar. 17, 2003 (JP) ..... P2003-072737
Mar. 18, 2003 (JP) ..... P2003-074516
Mar. 20, 2003 (JP) ..... P2003-076925
Mar. 24, 2003 (JP) ..... P2003-079710

(51) Int. Cl.
*B65H 9/00* (2006.01)

(52) U.S. Cl. ..... 271/226; 271/233; 270/58.09; 270/58.01

(58) Field of Classification Search ..... 271/226, 271/233; 270/58.09, 58.01
See application file for complete search history.

(56) References Cited

U.S. PATENT DOCUMENTS 5,284,338 A 2/1994 Allmendinger et al. ..... 271/220
5,288,062 A 2/1994 Rizzolo et al. ..... 270/58.12
5,639,079 A 6/1997 Suzuki et al. ..... 270/58.17
5,931,460 A 8/1999 Kadowaki et al. ..... 271/220
5,961,115 A 10/1999 Blanck et al. ..... 271/263
5,992,839 A 11/1999 Kosasa ..... 270/58.12
6,145,825 A 11/2000 Kunihiro et al. ..... 270/58.09
6,283,470 B1 9/2001 Hirai ..... 271/189
6,305,681 B1 10/2001 Watanabe et al. ..... 270/58.08
6,382,615 B1 5/2002 Ishiguro et al. ..... 270/58.12
6,398,214 B1 * 6/2002 Moteki et al. ..... 271/220
6,427,997 B1 8/2002 Hirota et al. ..... 270/58.12
6,527,269 B2 3/2003 Yamada et al. ..... 271/221
6,702,279 B2 3/2004 Adachi et al. ..... 271/220
6,799,759 B1 10/2004 McNamara et al. ..... 270/58.08
6,889,971 B2 5/2005 Tamura et al. ..... 270/58.11
6,889,974 B2 5/2005 Tamura et al. ..... 271/220
2002/0060414 A1 * 5/2002 Yamada et al. ..... 271/221

(Continued)

FOREIGN PATENT DOCUMENTS

JP 59-153764 9/1984

(Continued)

*Primary Examiner*—Patrick H Mackey
*Assistant Examiner*—Thomas A Morrison
(74) *Attorney, Agent, or Firm*—Morgan, Lewis & Bockius LLP

(57) ABSTRACT

When a new paper sheet is supplied onto a compiling tray, a sub-paddle holds down paper sheets having already been stacked on the compiling tray until a leading edge of the new paper sheet S touches the stacked paper sheets. Thereafter, the sub-paddle gets apart from the sheets stacked on the compiling tray with timing, with which the rear edge of the new paper sheet falls on the compiling tray.

4 Claims, 21 Drawing Sheets

U.S. PATENT DOCUMENTS

| | | | | |
|---|---|---|---|---|
| 2002/0063380 | A1 | 5/2002 | Tamura et al. | |
| 2002/0113362 | A1 | 8/2002 | Saito et al. | 271/207 |
| 2003/0190178 | A1 | 10/2003 | Sato et al. | 399/397 |
| 2005/0067764 | A1 | 3/2005 | Tamura et al. | |
| 2007/0108697 | A1 | 5/2007 | Tamura et al. | |
| 2007/0108698 | A1 | 5/2007 | Tamura et al. | |
| 2007/0145675 | A1 | 6/2007 | Tamura et al. | |

FOREIGN PATENT DOCUMENTS

| | | | |
|---|---|---|---|
| JP | 61-184560 | * | 8/1986 |
| JP | 4-77554 | | 7/1992 |
| JP | 5-73653 | | 10/1993 |
| JP | 6-171837 | | 6/1994 |
| JP | 7-49350 | B | 5/1995 |
| JP | 08-81111 | | 3/1996 |
| JP | 08-301504 | | 11/1996 |
| JP | 10-334210 | | 12/1998 |
| JP | 11-60026 | | 3/1999 |
| JP | 11-130338 | | 5/1999 |
| JP | 2999-191213 | | 7/2000 |
| JP | 2000-289922 | | 10/2000 |
| JP | 2002-068574 | | 3/2002 |
| JP | 2002-167195 | | 6/2002 |

* cited by examiner

SHEET PROCESSING APPARATUS AND SHEET BUNDLE ALIGNMENT METHOD

This is a divisional application of application Ser. No. 10/654,954, filed on Sep. 5, 2003, now abandoned which is hereby incorporated by reference.

BACKGROUND OF THE INVENTION

1. Field of the Invention

The present invention generally relates to a sheet processing apparatus for processing paper (sheets) discharged from an image forming apparatus, such as a printer and a copier, and, more particularly to a sheet processing apparatus having a mechanism for setting paper (sheets).

2. Description of the Related Art

In recent years, a sheet processing apparatus for receiving recorded paper (sheets) discharged from an image forming apparatus, such as a printer and a copier, and for applying predetermined post-processing to the recorded sheets has become widely used. This is because of the fact that an image forming apparatus, which assures high productivity by being provided with means for stapling, punching (or circularly boring), and folding paper, has come into common use, with promotion of the conversion of the image forming apparatus to an online apparatus and with enhancement of the record productivity of the image forming apparatus.

Among such sheet processing apparatuses, there has been a sheet processing apparatus in which, for example, stapling is performed by a stapling unit after recorded paper sheets are received and stacked on a stapling tray (that is, a compiling tray) and a sheet bundle includes a predetermined number of sheets is produced. Hitherto, there have been techniques of providing a predetermined regulating member on a stapling tray in such a sheet processing apparatus in such a way as to extend in a direction of thickness of a sheet so as to enhance ability to stack sheets on the stapling tray, as disclosed in JP-A-11-130338. Further, there have been techniques, which are applied to such a processing apparatus, for performing outward three-folding processing (that is, z-folding) on recorded paper sheets and for aligning the paper sheets by stacking the z-folded sheets on a stapling tray, that is, a compiling tray as disclosed in JP-B-7-49350.

Meanwhile, Z-folded paper has been subjected to folding, and thus has become pliant. Consequently, there has been a fear that when a new paper sheet (that is, a z-folded sheet) is discharged onto paper sheets that have already been aligned on a compiling tray, this new paper sheet may strongly hit the topmost one of the sheets aligned on the compiling tray and disturb the alignment of the sheets. Incidentally, this technical problem may occur not only in the case that Z-folded sheets are discharged to the compiling tray, but in the case that, for example, pliant cardboards are discharged to the compiling tray.

Incidentally, JP-A-11-130338 discloses techniques for providing a regulating/pressing member adapted to guide rear edges of paper sheets, and for moving this regulating/pressing member in the direction of thickness of a paper bundle according to the number of paper sheets stacked on the stapling tray. This official gazette describes that even when the number of paper sheets changes, rounded paper sheets can favorably be aligned. However, it is difficult to enhance ability to accommodate the paper sheets, which are heated and pressured and extended by, for instance, a fixing portion, simply by moving the regulating/pressing member in the direction of thickness of paper sheets to thereby change the thickness of the paper sheets. To enhance the quality of alignment of paper sheets on a tray, such as a stapling tray, for stacking discharged paper sheets (that is, output paper sheets on each of which an image is formed), it is preferable that an appropriate conveyance force is stably provided to the paper sheets. JP-A-11-130338 does not describe this problem.

Further, paper sheets to be stacked are not limited to plain paper used in design. For example, z-folded paper sheets and extremely thick paper sheets described in, for instance, JP-B-7-49350 may be used as the paper sheets to be stacked. In the case of the techniques disclosed in JP-A-11-130338, the regulating/pressing member is moved according to the number of paper sheets. However, when folded paper sheets or thick paper sheets are supplied, the thickness of a sheet bundle is thicker than a total thickness of sheets of the number, which are to be counted. Thus, the situation of the stacked paper sheets largely changes according to the kind of paper sheet to be stacked. Consequently, even when the regulating/pressing member is moved in the direction of thickness of a sheet bundle, sufficient functions cannot be obtained. Especially, in the case of a z-folded paper sheet, swells frequently occur at folded parts thereof. Failures of alignment are liable to occur.

According to the techniques disclosed in JP-A-11-130338, only the regulating/pressing member is simply moved. For instance, sometimes, drive members adapted to provide a predetermined conveyance force for alignment are caused to perform up-and-down motions. In such a case, when stacked paper sheets are not sufficiently controlled, the conveyance force largely deviates from a design value thereof. Thus, serious damage may be caused to paper sheets.

Further, Z-folded paper described in JP-B-7-49350 has been subjected to folding, and thus has become pliant. Consequently, there has been a fear that when a new paper sheet (that is, a z-folded sheet) is discharged onto paper sheets that have already been aligned on a compiling tray, this new paper sheet strongly hits the topmost one of the sheets aligned on the compiling tray and disturbs the alignment of the sheets. To obtain good ability to align paper sheets that are extremely thick, it is required to provide an appropriate conveyance force onto the thick paper sheets and to perform a putting-aside operation on the paper sheets with favorable conveyance timing.

In recent years, there have been demands for high-speed sheet processing. Thus, when a sheet processing apparatus is connected to an image forming apparatus that outputs paper sheets, on each of which an image is formed, at high speed, it is necessary to significantly reduce time required for alignment of paper sheets. To meet such necessity, it is demanded that high-speed alignment of page sheets is realized, and that even when such high-speed alignment is achieved, various kinds of paper sheets are orderly stacked.

SUMMARY OF THE INVENTION

The invention is accomplished to solve the aforementioned technical problems.

Accordingly, one object of the invention is to restrain the alignment of a paper bundle (that is, a sheet bundle) of paper sheets, which have already been aligned on a compiling tray, from being disturbed by paper (or a sheet) newly supplied onto the compiling tray.

Further, a second object of the invention is to provide an appropriate conveyance force even when paper bundles have different thickness, respectively, and to enhance paper alignment accuracy.

Further, a third object of the invention is to maintain high quality of alignment of paper sheets even when the paper sheets are highly curled and swelled.

Further, a fourth object of the invention is to achieve alignment at high speed and to ensure good quality of alignment of a paper bundle.

Further, a fifth object of the invention is to ensure good quality of alignment of paper sheets even when the paper sheets are z-folded sheets or special paper sheets.

Further, a sixth object of the invention is to ensure good quality of alignment of paper sheets even when thick paper sheets or folded sheets are provided.

Further, a seventh object of the invention is to control members in consideration of influence of folded parts when folded paper sheets are supplied to the compiling tray.

To achieve the foregoing objects, according to one aspect of the invention, there is provided a sheet processing apparatus that includes a compiling tray for forming a sheet bundle by sequentially collecting sheets supplied thereto, a sheet alignment portion for aligning sheets supplied to the compiling tray, and a pressing member, provided in such a way as to be able to advance and retract in a direction of thickness of the sheets collected in the compiling tray, for holding sheets already collected in the compiling tray and aligned in the sheet alignment portion when a new sheet is supplied to the compiling tray.

The pressing member may be provided in such a way as to advance and retract between an advancing position, at which the pressing member presses sheets on the compiling tray, and a retreating position at which the pressing member does not hinder the sheets on the compiling tray from being discharged therefrom. Further, the retreating position and the advancing position of the pressing member may be changed according to a thickness of sheets collected on the compiling tray.

The sheet processing apparatus may further includes a guide member, provided in such a way as to be able to be interlocked with the pressing member, for guiding a sheet newly supplied to the compiling tray. Advancing and retracting operations of the pressing member may be adapted to vary according to whether or not folding is performed on sheets newly supplied to the compiling tray, and according to what supply portion supplies sheets newly to the compiling tray, or according to a thickness of sheets newly supplied to the compiling tray. The pressing member may press sheets already collected on the compiling tray before a leading end of a sheet newly supplied to the compiling tray touches the sheets already collected thereon. The pressing member goes away from the collected sheets before a rear end of the newly supplied sheet is discharged onto the compiling tray.

According to a second aspect of the invention, there is provided a sheet processing apparatus that includes a compiling tray for forming a sheet bundle by sequentially collecting sheets supplied thereto, a sheet alignment portion for aligning sheets supplied to the compiling tray, and a pushing member, provided in such a way as to be able to advance to and retract from the compiling tray, for pushing, when a new sheet supplied to the compiling tray abuts against a topmost sheet of sheets already collected on the compiling tray, the topmost sheet in a direction opposite to a supplying direction in which the new sheet is supplied. In this sheet processing apparatus, the pushing member may be constituted by a paddle member rotatably provided.

According to a third aspect of the invention, there is provided a sheet processing apparatus that includes a compiling tray for forming a sheet bundle by sequentially collecting sheets supplied thereto, a sheet alignment portion for aligning sheets supplied to the compiling tray, and a grasping member, provided in such a way as to be able to advance to and retract from the compiling tray, for grasping, when a new sheet supplied to the compiling tray abuts against a topmost sheet of sheets already collected on the compiling tray, one or a plurality of the sheets collected on the compiling tray. In this sheet processing apparatus, the grasping member grasps a conveying direction end portion of one or each of a plurality of sheets collected on the compiling tray.

According to a fourth aspect of the invention, there is provided a sheet processing apparatus in which conveyed sheets are received by and stacked on a compiling tray, and in which the rear ends of the sheets stacked on this compiling tray are aligned by the longitudinal reference wall to thereby perform alignment of the sheets. A longitudinal alignment portion provides a predetermined conveyance force to sheets sequentially supplied to the compiling tray, and pushes the sheets against the longitudinal reference wall. This longitudinal alignment portion changes a reference position in a direction of thickness of the sheets stacked on the compiling tray.

Incidentally, this longitudinal alignment portion may be a member that turns by simultaneously touching a surface of the sheet. More specifically, a paddle member adapted to turn simultaneously touching the surface of the sheet may be employed as the longitudinal alignment portion. The reference position in the longitudinal alignment may change according to the number of sheets stacked on the compiling tray. More concretely, the reference position in the longitudinal alignment portion may include a lower position, which corresponds to a state in which a small number of sheets are stacked on the compiling tray, and an upper position corresponding to a state in which a large number of sheets being more than a predetermined number of sheets are stacked on the compiling tray. The longitudinal alignment portion may convey sheets to the longitudinal reference wall when placed at a sheet alignment position. The longitudinal alignment portion once may move from the sheet alignment position to a sheet pressing position in synchronization with predetermined sheet conveying timing and thereafter may return to the sheet alignment position.

According to a fifth aspect of the invention, there is provided a sheet processing apparatus that includes a compiling tray for receiving and stacking conveyed sheets, a longitudinal reference wall for performing alignment of sheets stacked on the compiling tray by causing rear ends of the sheets to abut against the compiling tray, a sheet conveying unit, enabled to move in a direction of thickness of a sheet, for conveying sheets to the longitudinal reference wall, and a regulating unit for regulating a position in a direction of thickness of the sheet in the sheet conveying unit. In this processing apparatus, the regulating unit may be a member that moves in such a way as to follow a trajectory similar to a trajectory of movement in a direction of thickness of the sheet in the sheet conveying unit. More concretely, the regulating unit may be a member shaped nearly a disk, provided coaxially with a shaft, around which the sheet conveying unit turns. When the regulating unit may abut against a surface of a sheet, an abutting part of the regulating unit is displaced so that displacement of the abutting part is nearly equivalent to movement of the sheet. Alternatively, the regulating unit may be a member shaped nearly a disk, provided coaxially with a shaft, around which the sheet conveying unit turns. Further, when the regulating unit abuts against a surface of a sheet, an abutting part of the regulating unit may be displaced so that displacement of the abutting part is nearly equivalent to movement of the sheet. Alternatively, the regulating unit may regulate positions in a direction of thickness of a sheet of the sheet conveying unit by using different members according to the thickness of the sheet.

According to a sixth aspect of the invention, sheet processing apparatus that includes a compiling tray for receiving and stacking conveyed sheets, a first regulating member, adapted to abut against a surface of an nth sheet ("n" is an integer equal to or more than 2) of sheets of a sheet bundle, for regulating a direction of thickness of the sheet bundle, and second regulating member, adapted to abut against a surface of an (n−1)'th sheet supplied to the compiling tray by preceding the nth sheet, for regulating a direction of thickness of the sheet bundle. This sheet processing apparatus may further includes a sheet conveying unit for conveying rear ends of sheets to be supplied to the compiling tray. The first regulating member may be provided in vicinity of a conveying operation position at which the sheet conveying unit performs a conveying operation. The second regulating member may be provided in vicinity of a reference wall for aligning rear ends of sheets supplied to the compiling tray. The second regulating member may retract from a surface of the (n−1)'th sheet before the nth sheet to be supplied to the compiling tray reaches there.

According to a seventh aspect of the invention, there is provided sheet processing apparatus sheet processing apparatus that includes a compiling tray for receiving and stacking conveyed sheets, a longitudinal reference wall for performing alignment of sheets stacked on the compiling tray by aligning rear ends of the sheets, a sheet conveying unit for conveying sheets to the longitudinal reference wall, a first regulating unit, provided in vicinity of the sheet conveying unit, for pressing a top surface of a sheet bundle each time a predetermined number of sheets are discharged, and a second regulating unit, provided in vicinity of the longitudinal reference wall, for pressing the top surface of the sheet bundle each time the predetermined number of sheets are discharged. In this processing apparatus, the sheet conveying unit may change a reference position in a direction of thickness of a sheet when a predetermined number of sheets are stacked on the compiling tray. The first regulating member and the second regulating member may be displaced in a direction of thickness of the sheet by using the reference position, which is changed by the sheet conveying unit, as a reference.

According to an eighth aspect of the invention, there is provided a sheet-bundle alignment method for forming a sheet bundle by aligning rear ends of sheets received and stacked on the compiling tray, which includes the steps of pushing a rotational member against a surface of a sheet and conveying sheets to a reference wall on which rear ends of sheets are aligned, counting sheets supplied to the compiling tray, and changing a reference position of the rotational member in a direction of thickness of a sheet when the number of sheets to be counted exceeds a predetermined value. The reference position to be changed may be changed in a direction of thickness of the sheet in such a way as to be away from the sheet. After the reference position is changed, the reference position may be further changed with respect to the direction of thickness of the sheet with predetermined timing by repeatedly employing an approaching direction and a separating direction According to a ninth aspect of the invention, there is provided a sheet processing apparatus that includes a compiling tray for receiving and stacking supplied sheets, a longitudinal reference wall for performing alignment of sheets stacked on the compiling tray by aligning rear ends of the sheets, a first moving-aside unit for moving the sheets aside toward the longitudinal reference wall at a rear end side of the sheets supplied to the compiling tray, and a second moving-aside unit for moving the sheets aside toward the longitudinal reference wall at a leading end side of each of the sheets. In this processing apparatus, the second moving-aside unit is provided closer to the leading end side than the first moving-aside unit. Further, a conveyance force of the second moving-aside unit is used for moving the sheets aside toward the longitudinal reference wall, and set therein in such a way as to be variable.

In this processing apparatus, the second moving-aside unit may be enabled to move in a direction of thickness of a sheet bundle accommodated in the compiling tray. The second moving-aside unit may change a position thereof in a direction of thickness of a sheet bundle according to the sheet bundle stacked on the compiling tray. The processing apparatus may be adapted so that when the sheet bundle stacked on the compiling tray is thick, the second moving-aside unit moves in a direction in which the second moving-aside unit goes away from a surface of the sheet. The second moving-aside unit may be set in a manner that varies according to whether or no folding is performed on sheets stacked on the compiling tray.

According to a tenth aspect of the invention, there is provided a sheet processing apparatus, which includes a compiling tray for receiving and stacking supplied sheets, a longitudinal reference wall for performing alignment of sheets stacked on the compiling tray by aligning rear ends of the sheets, and a sheet moving-aside unit, adapted to reciprocate between an upper position and a lower position each time a sheet is supplied to the compiling tray, for moving the sheet aside toward the longitudinal reference wall.

The upper position of the sheet moving-aside unit may be set in such a way as not to hinder supply of a sheet to the compiling tray. The lower position of the sheet moving-aside unit may be set in such a way as to provide a sheet with a conveyance force needed for moving the sheet aside toward the longitudinal reference wall. The upper position and the lower position of the sheet moving-aside unit may change according to a state of sheets stacked on the compiling tray. Further, this sheet processing apparatus may further include a guide member, which is operated by being interlocked with the sheet moving-aside unit, for regulating a top surface of sheets supplied to the compiling tray.

According to a eleventh aspect of the invention, there is provided a sheet processing apparatus, which includes a compiling tray for receiving and stacking supplied sheets, a longitudinal reference wall for performing alignment of sheets stacked on the compiling tray by aligning rear ends of the sheets, a compiling paddle, provided in the vicinity of the end wall, for moving the sheet aside toward the end wall, a sub-paddle, provided at a place located in a direction of a leading end of the sheet in such a way as to be closer to the leading end than the compiling paddle, for assisting the compiling puddle in moving the sheet aside, a stapler for performing stapling on a sheet bundle aligned on the end wall, and a controller for changing a distance of the sub-paddle from a top surface of the compiling tray.

The controller may cause a predetermined drive power source to operate each time a sheet is supplied to the compiling tray, and also cause the sub-paddle to move between an upper position and a lower position in a direction of thickness of the sheet. The controller causes a predetermined drive power source according to a situation of a sheet to be supplied to the compiling tray, and changes the distance. The controller may count sheets supplied to the compiling tray and may change the distance according to the counted number of the sheets. The controller may judge whether or not folding is performed on sheets supplied to the compiling tray. Only when folding is performed thereon, the controller may change the distance according to the folding.

According to a twelfth aspect of the invention, there is provided a sheet bundle alignment method for forming a sheet bundle by aligning rear ends of conveyed sheets received and stacked by the compiling tray, which includes the steps of pushing a rotary member against a surface of a sheet in synchronization with supply of the sheet and conveying sheets to a reference wall for aligning the rear end of a sheet, grasping a situation of sheets supplied to the compiling tray, and changing a conveyance force of the rotary member according to the situation of the sheets. The conveyance force may be changed by changing a distance of the rotary member from a sheet stacking surface of the compiling tray.

According to a thirteenth aspect of the invention, there is provided a sheet processing apparatus, which includes a compiling tray for receiving and stacking supplied sheets, a counting unit for counting sheets supplied to the compiling tray, and an execution unit for performing a predetermined operation on the sheets according to a count obtained by the counting unit. In this processing apparatus, in the case that the sheets supplied to the compiling tray have undergone predetermined post-processing, the counting unit counts the sheets by converting one sheet of the sheets into n-sheets (n>1).

Incidentally, this post-processing may include folding and punching performed on the sheets, for example, the outward-three-folding (that is, z-folding). The execution unit may convert one sheet of the sheets into n-sheets (n>1) for controlling a part thereof acting upon overlapped portions of each of the sheets, on which the folding is performed. The execution unit may be a member for guiding the sheets toward a longitudinal reference wall. The execution unit may perform an operation of moving in a direction of thickness of the sheets according to a count obtained by the counting unit. A value of the "n" (n>1), which is converted by the counting unit, varies according to a kind of the post-processing, a kind of the sheet, a size of the sheet, and a stacking condition of the sheets to which the post-processing is performed.

According to a fourteenth aspect of the invention, there is provided a sheet processing apparatus, which includes a compiling tray for receiving and stacking supplied sheets, a counting unit for counting sheets supplied to the compiling tray, and an execution unit for performing a predetermined operation on the sheets according to a count obtained by the counting unit. In this processing apparatus, in the case that the sheets supplied to the compiling tray are thick paper sheets, the counting unit counts the sheets by converting one sheet of the sheets into n-sheets (n>1). More practically, a value of the "n" (n>1), which is converted by the counting unit, varies according to a thickness of the supplied sheet. This sheet processing apparatus may further include a judging unit for judging whether or not the sheet supplied to the compiling tray is a thick paper sheet. The judging unit may judge from a sheet supplying portion, from which the sheet is supplied to the compiling tray, and from a thick paper designation from a user that the sheet supplied to the compiling tray is a thick paper sheet.

According to a fifteenth aspect of the invention, there is provided a sheet processing apparatus that includes a compiling tray, whose stackable number of sheets is preliminarily determined, for sequentially receiving and stacking conveyed sheets, and a sheet aligning unit for aligning sheets stacked on the compiling tray. In this processing apparatus, the compiling tray is enabled to receive folded sheets. The stackable number of sheets stacked on the compiling tray is determined by converting one sheet of the folded sheets into n-sheets (n>1).

According to a sixteenth aspect of the invention, there is provided a sheet processing apparatus that includes a compiling tray, whose stackable number of sheets is preliminarily determined, for sequentially receiving and stacking conveyed sheets, and a stapler for performing stapling on sheets stacked on the compiling tray. In this processing apparatus, the compiling tray is enabled to receive folded sheets. The stackable number of sheets stacked on the compiling tray is determined by converting one sheet of the folded sheets into n-sheets (n>1).

According to a seventeenth aspect of the invention, there is provided a sheet processing apparatus that includes a compiling tray for receiving and stacking supplied sheets, a longitudinal reference wall, against which a sheet conveying direction end portion of each of the sheets to be supplied to the compiling tray is made to abut thereby to align the sheets, a longitudinal alignment unit, enabled to move in a direction of a sheet bundle stacked on the compiling tray, for aligning the sheets along the longitudinal reference wall, and a controller for controlling movement in a direction of thickness of the sheet bundle in the longitudinal alignment unit. In this processing apparatus, the controller causes the longitudinal alignment unit with different timing according to sheets supplied to the compiling tray.

Incidentally, the controller may cause the longitudinal alignment unit to move, according to the number of sheets stacked on the compiling tray. In the case that folded sheets are supplied to the compiling tray, the controller may cause the longitudinal alignment unit to move, when the number of stacked sheets is smaller than that of sheets, which are stacked on the compiling tray, and which are not subjected to folding. The controller may cause the longitudinal alignment unit to move, according to the number of sheets stacked on the compiling tray. In the case that folded sheets are supplied to the compiling tray, the controller may cause the longitudinal alignment unit to move, when the number of stacked sheets is smaller than that of sheets, which are supplied to the compiling tray, and which have an ordinary thickness.

According to a eighteenth aspect of the invention, there is provided a sheet processing apparatus that includes a compiling tray for receiving and stacking supplied sheets, an end wall against which a rear end of each of sheets stacked on the compiling tray is made to abut, a compiling paddle, provided in the vicinity of the end wall, for moving sheets, which are supplied to the compiling tray, aside toward the end wall, a sub-paddle, provided at a place in a direction of a leading end of each of the sheets in such a way as to be closer to the leading end than the compiling paddle, for assisting the compiling paddle in moving the sheets aside, a stapler for performing stapling on a sheet bundle aligned along the end wall, and a controller for causing the compiling paddle and/or the sub-paddle to move in a direction of thickness of sheets stacked on the compiling tray, and for controlling timing, with which the controller moves the compiling paddle and/or the sub-paddle in the direction of thickness according to processing conditions of the stacked sheets and/or the thickness of the sheets. The controller may move the compiling paddle and the sub-paddle in the direction of thickness with different timing in the case that folding is performed on the sheets.

According to a nineteenth aspect of the invention, there is provided a sheet bundle aligning method for forming a sheet bundle by aligning conveying direction end portions of sheets supplied to the compiling tray, on which the conveyed sheets are stacked, which includes the steps of counting sheets supplied to the compiling tray, correcting the number of the counted sheets, pushing a rotary member against a surface of a sheet in synchronization with the sheet, and conveying the sheet to the reference wall for aligning the conveying direction end portions, and changing a conveyance force of the rotary member according to the corrected number of sheets.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Hereinafter, embodiments of the invention are described by referring to the accompanying drawings.

First Embodiment

Figure 1:
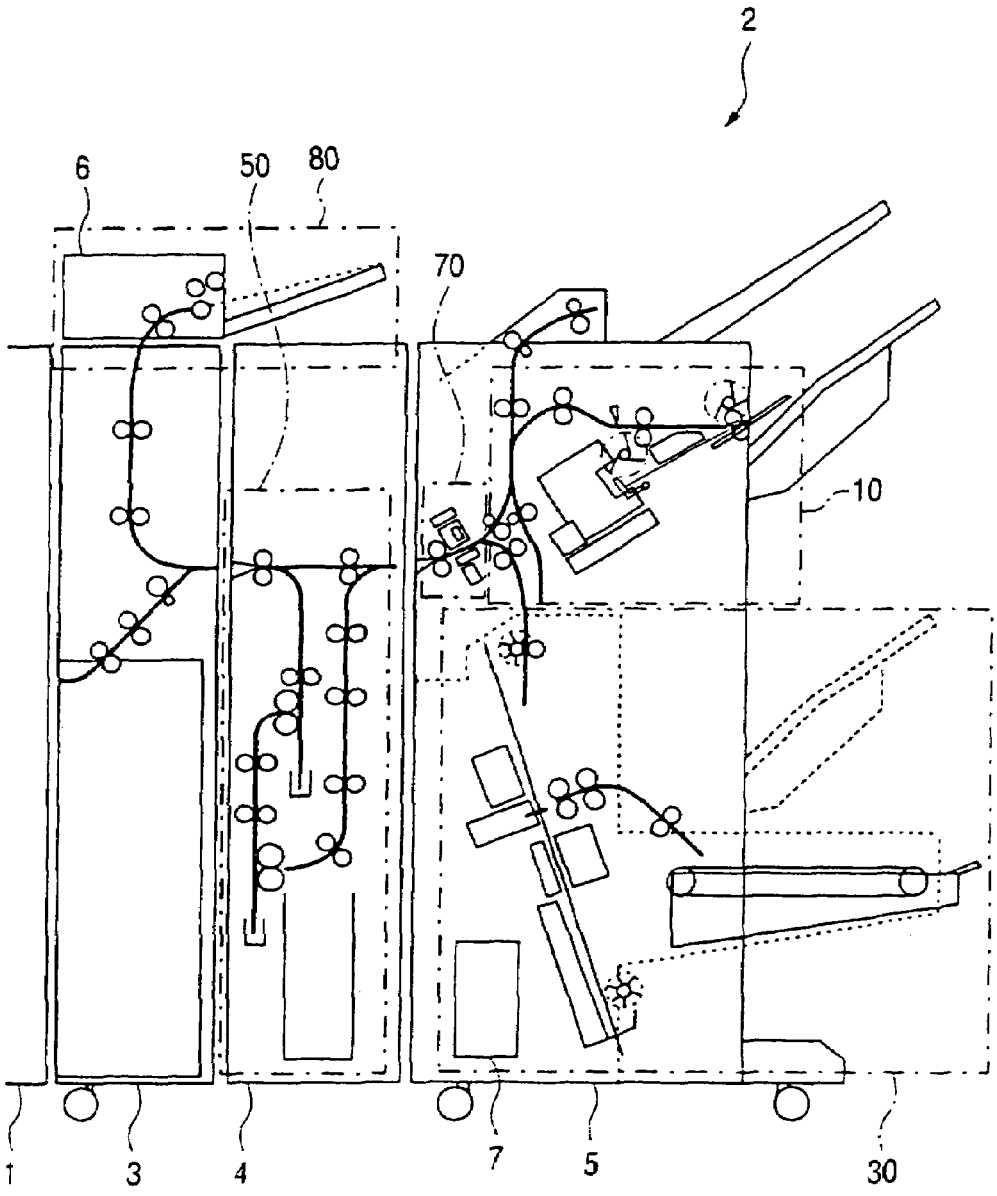
FIG. 1 is a view illustrating the entire configuration of a sheet processing apparatus to which an embodiment of the invention is applied.

FIG. 1 is a view illustrating the entire configuration of a sheet processing apparatus to which the invention is applied. The sheet processing apparatus (or paper processing apparatus) 2 is connected to an image forming apparatus 1, such as a printer or a copier, which forms a color image by, for example, an electrophotographic method. The sheet processing apparatus 2 is used as a post-processing apparatus. This post-processing apparatus 2 has a transport unit 3 connected to the image forming apparatus 1, and also has a folding unit 4 for performing folding processing on the (paper) sheets taken in by this transport unit 3, a finisher 5 for performing predetermined final processing on sheets having passed through this folding unit 4, an interposer 6 for supplying inserting paper such as a front cover of a brochure, and a controller 7 for controlling each of mechanism portions of the sheet processing apparatus 2. Incidentally, although the controller 7 shown in FIG. 1 is provided in a casing of the finisher 5, the controller 7 may be provided in a casing of another unit of the processing apparatus 2. Further, all control functions may be integrated in a main unit of the image forming apparatus 1.

The sheet processing apparatus 2 including such units is divided into function portions in terms of functions thereof. That is, the sheet processing apparatus 2 has a stapling function portion 10, which is provided in the finisher 5 and produces paper bundles and performs stapling thereof, and a saddle stitch binding function portion 30, which is provided in the finisher 5 and adapted to saddle-stitch the paper bundles and to bind up a book. The sheet processing apparatus 2 also has a folding function portion 50, which is provided in the folding unit 4, for performing what is called an inward three-folding (that is, C-folding) and what is called an outward three-folding (that is, Z-folding) on sheets, a punching function portion 70, provided in, for example, the finisher 5, for performing two-hole or four-hole drilling (or punch), and an inserting paper function portion 80, constituted by an interposer, for providing cardboards used as covers of a paper bundle and inserting paper, such as fenestrated paper.

Next, the stapling function portion 10, which is a feature of this embodiment, is described in detail hereinbelow.

Figure 2:
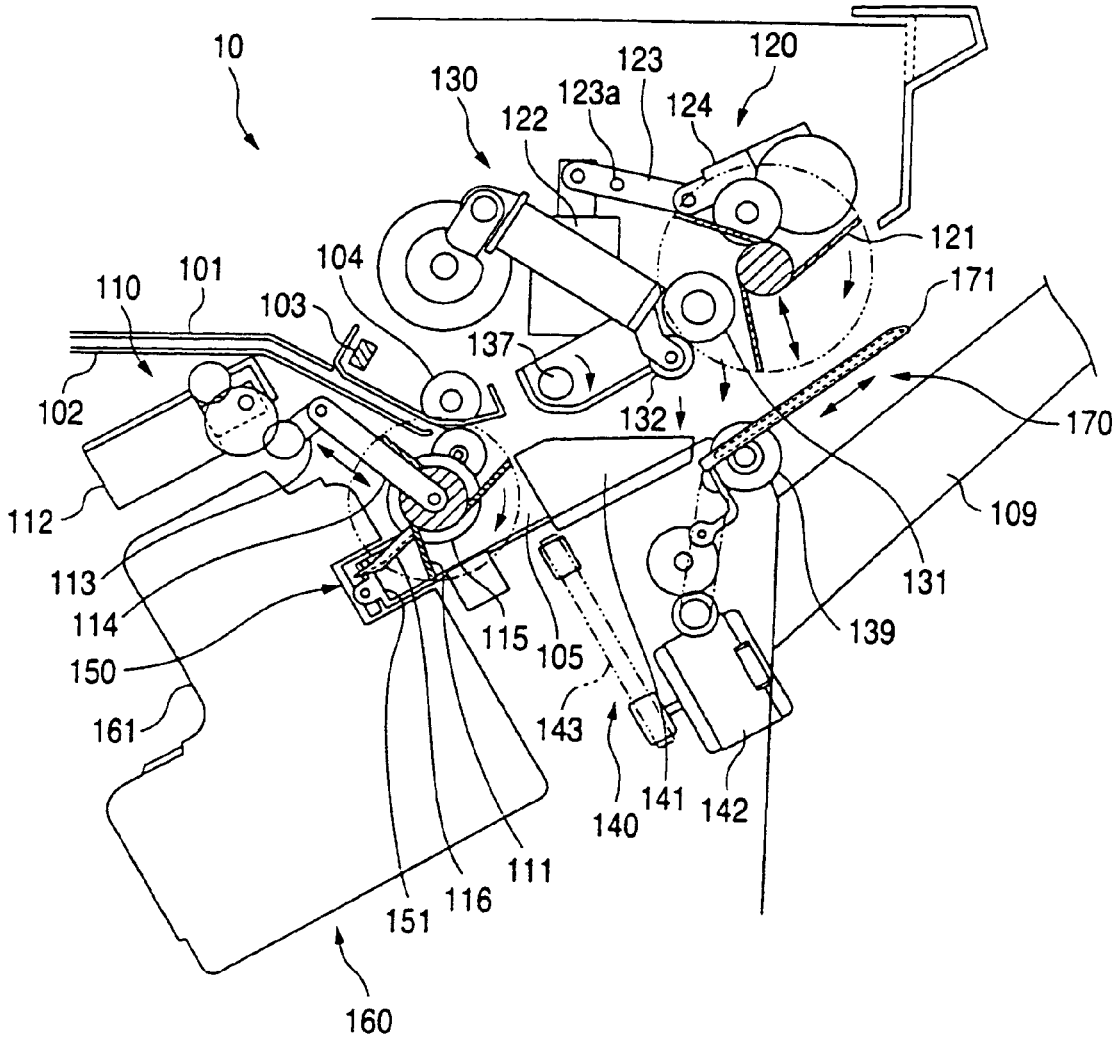
FIG. 2 is a view illustrating the configuration of a stapling function portion.

FIG. 2 is a view illustrating the configuration of the stapling function portion 10. The stapling function portion 10 has conveyance guides 101 and 102 for guiding paper sheets to be conveyed, an compile-exit sensor 103 for detecting a paper sheet and for outputting a signal, which is used for controlling an operation of each of mechanism portions, a conveyance roller pair 104 for discharging (or conveying) paper sheets conveyed through the space between the conveyance guides 101 and 102, and a compiling tray 105 on which the sheets discharged by the conveyance roller pair 104. The stapling function portion 10 is also provided with a discharging tray 109 for discharging a stapled brochure. The compiling tray 105 is provided with a longitudinal reference wall (that is, an end wall (to be described later)), which serves as a reference wall for longitudinal alignment (that is, alignment in a direction in which a paper sheet is conveyed), in such a way as to extend in a direction opposite to a discharging direction in which paper sheets are discharged. The compiling tray 105 has a transversal reference wall (not shown), which is provided on, for instance, a near side (that is, a front side) of the apparatus and serves as a reference wall for transversal alignment (that is, alignment in a direction perpendicular to the direction in which a paper sheet is conveyed.

The stapling function portion 10 also has the following mechanism portions for performing various functions, that is, a longitudinal alignment portion 110, provided in the vicinity of the longitudinal reference wall, for performing longitudinal alignment (that is, alignment in a paper conveying direction) of paper sheets supplied to the compiling tray 105, a longitudinal alignment assisting portion 120, provided at a place located in a direction of a leading end of a paper sheet of the longitudinal alignment portion 110, for assisting the longitudinal alignment portion 110 in performing the alignment in a paper conveying direction (or the longitudinal alignment) of paper sheets, a paper bundle supporting/discharging portion 130 for holding a paper bundle during stapling so as to improve the quality of alignment of the paper bundle and for discharging the stapled paper bundle, and a transversal alignment portion 140 for performing alignment in a direction perpendicular to the paper conveying direction (that is, a transversal alignment) of paper sheets supplied to the compiling tray 105. The stapling function portion 10 also has an end wall 151 serving as a wall to be used for the longitudinal alignment of paper sheets, and an end wall portion 150 having a mechanism for driving this end wall 151. The stapling function portion 10 further has a stapling head 161, a stapling mechanism portion 160 for performing stapling on a paper bundle supplied to the compiling tray 105, a shelf 171 serving as a guide for supporting paper sheets in the compiling tray 105, and a shelf mechanism portion 170 having a mechanism for driving this shelf 171.

First, the longitudinal alignment portion 110 is described hereinbelow.

The longitudinal alignment portion 110 has compiling paddles 111 each for pushing paper sheets serially supplied to the compiling tray 105 against the end wall 115, a compiling paddle up/down solenoid 112 for causing the compiling paddle 111 to perform up-and-down motions (that is, retracting/advancing motions), links 113 and 114 interlocked with the compiling paddle up/down solenoid 112 and adapted to rotate and slide, a first regulating guide (that is, a first regulating member) 115 and a second regulating guide (that is, a second regulating member) 116, which function as a regulating member for assisting alignment of paper sheets by holding a highly curly paper sheet. Each of the compiling paddle 111 is formed from, for example, EPDM and has three vanes or so. These vanes rotate in such a way as to pat the surface of each of paper sheets supplied to the compiling tray 105. The rear edge of each of the paper sheets is pushed by this rotation thereof against the end wall 151. This enables the (longitudinal) alignment of the rear edges of the paper sheets.

Figure 3:
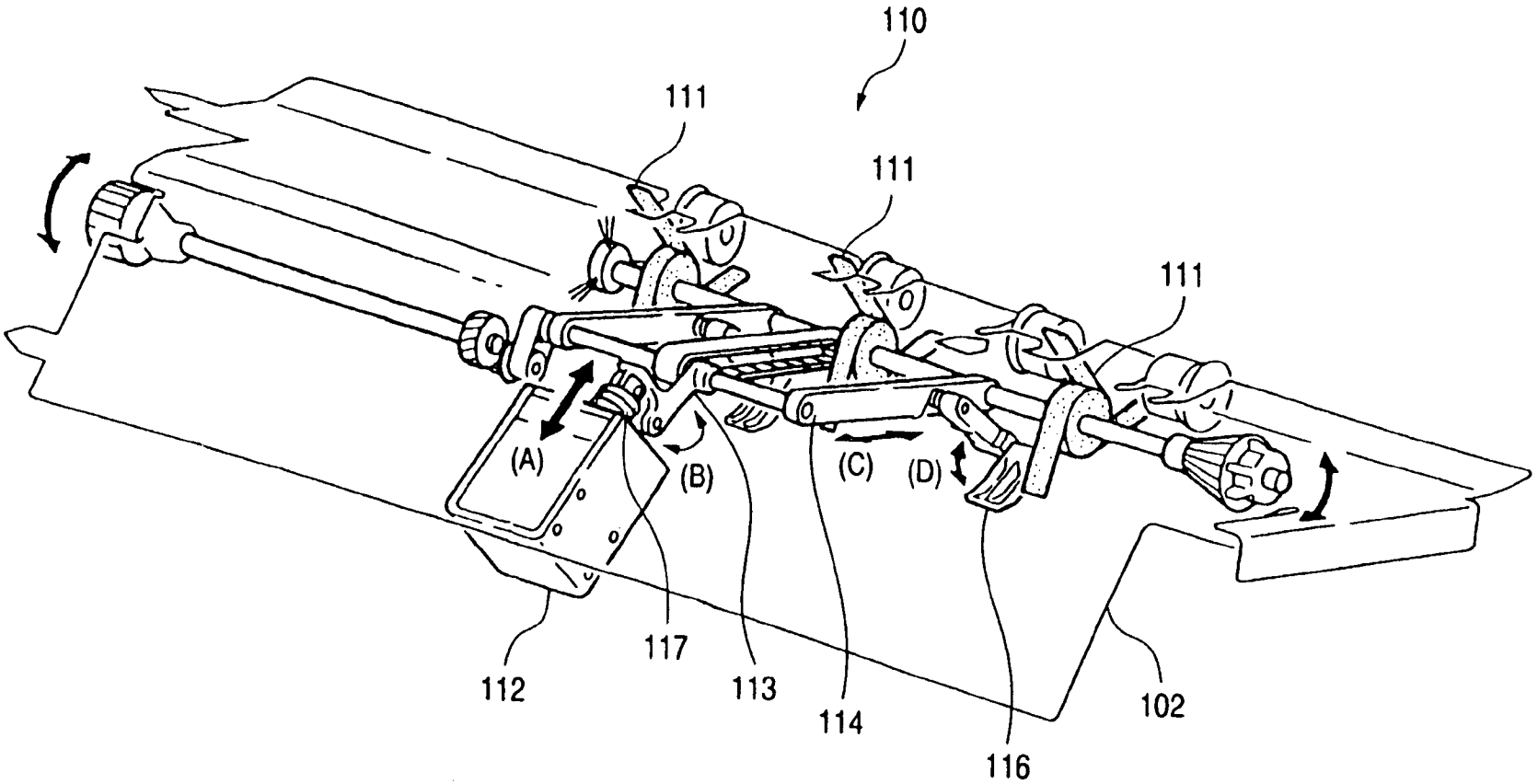
FIG. 3 is a perspective view illustrating each of mechanisms of a longitudinal alignment portion.

FIG. 3 is a perspective view illustrating each of mechanisms of the longitudinal alignment portion 110. Although the drawing of the first regulating guide 115 is omitted for easiness of viewing the drawing. Practically, a plurality (for example, 3 or 4) of longitudinal alignment portions 110 are respectively provided coaxially with the compiling paddles 111. A spring 117 is provided around the shaft of the compiling paddle up/down solenoid 112. When the shaft of the compiling paddle up/down solenoid 112 is moved in a direction indicated by "(A)" by the action of the compiling paddle up/down solenoid 112 and the spring 117, the link 113 is turned in a direction indicated by "(B)", and the link 114 is slid in a direction indicated by "(C)". The motions of these links 113 and 114 enable the up-and-down motions of the compiling paddles 111 with necessary timing, with which such motions of the paddles 111 are needed, according to the number of stacked paper sheets and to the thickness of the paper bundle. On the other hand, the second regulating guide 116 rotates in a direction indicated by "(D)" in synchronization with an operation in the direction indicated by "(C)" of the link 114. This enables the guide 116 to press down the rear edge of a highly curly paper sheet. Incidentally, the configuration and operation of the longitudinal alignment portion 110 will be described in detail later.

Next, the longitudinal alignment assisting portion 120 is described hereinbelow.

The longitudinal alignment assisting portion 120 has a sub-paddle 121 for assisting an operation of pushing paper sheets, which are supplied to the compiling tray 105, against the end wall 15, a sub-paddle up/down solenoid 122 for causing the sub-paddle 121 to perform up-and-down motions (that is, retracting/advancing operations), for example, raise the position thereof when the number of paper sheets reaches a predetermined value (50), and links 123 and 124, interlocked with the sub-paddle up/down solenoid 122, for causing the sub-paddle 121 to perform up-and-down motions. The sub-paddle 121 is constituted by EPDM, and provided with three or so of vanes, similarly as a compiling paddle 111. These vanes assist the longitudinal alignment of paper sheets supplied to the compiling tray 105.

Figure 4:
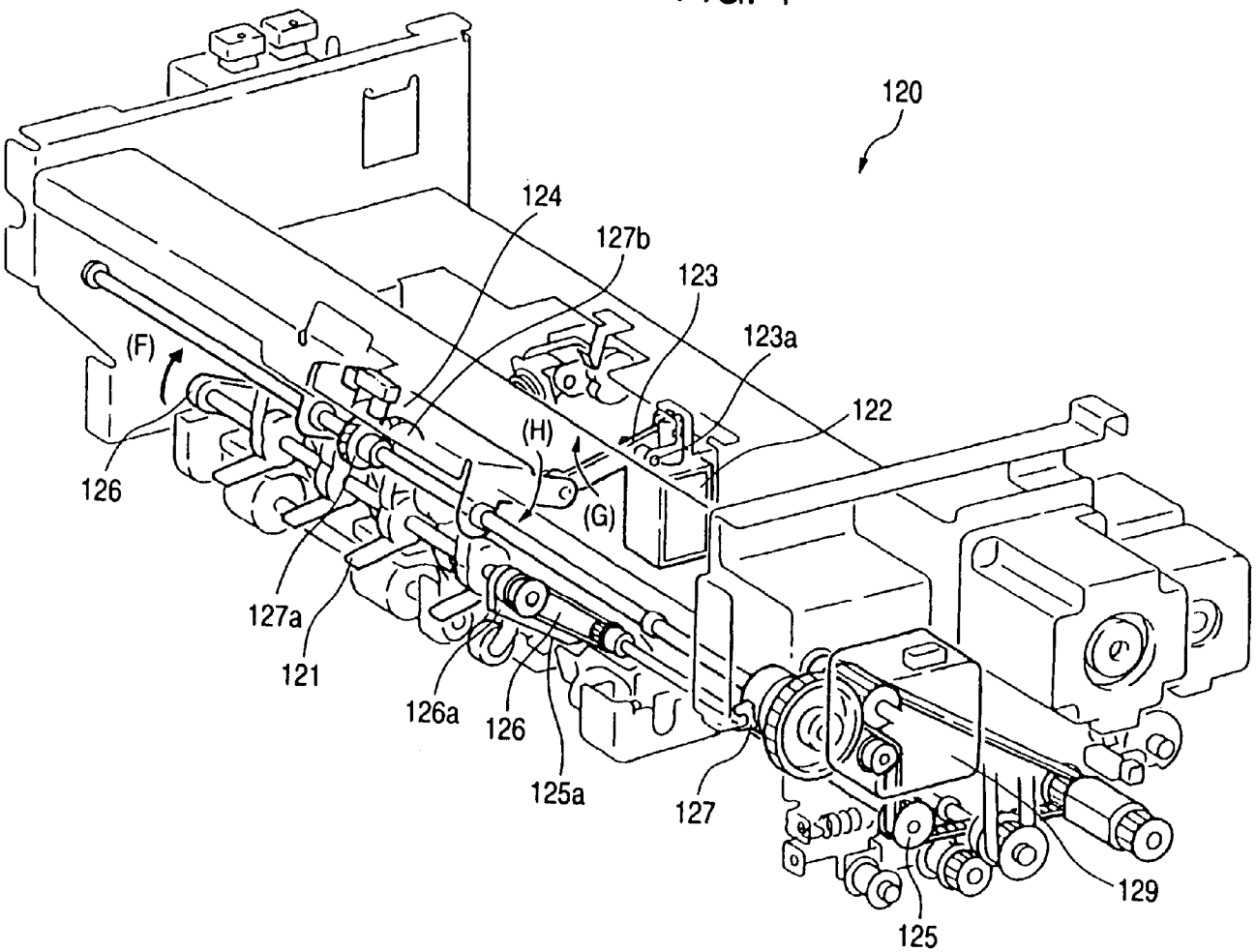
FIG. 4 is a perspective view illustrating each of mechanisms of a longitudinal alignment assisting portion.
Figure 5:
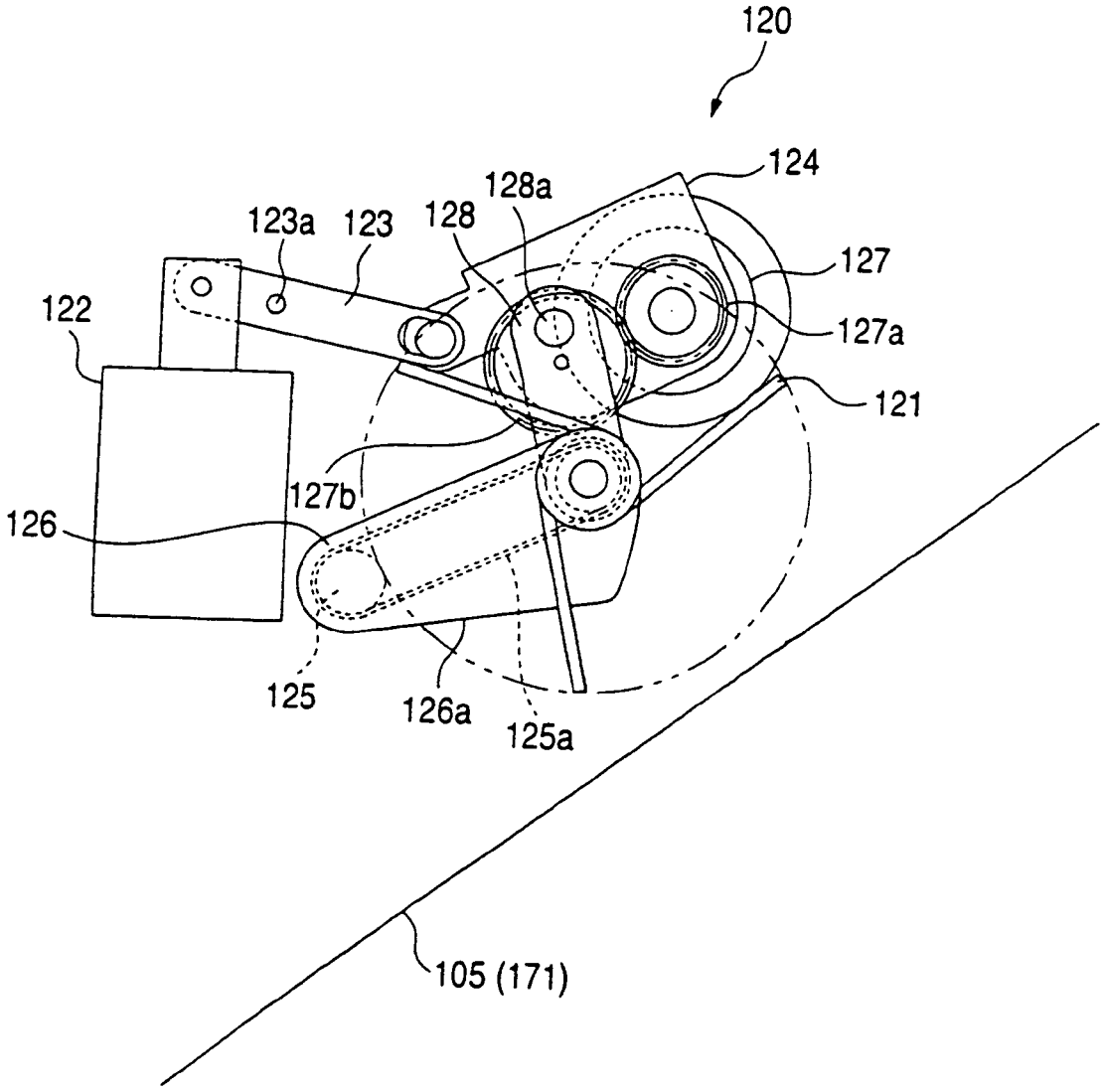
FIG. 5 is a side view illustrating each of the mechanisms of the longitudinal alignment assisting portion.

FIG. 4 is a perspective view illustrating each of mechanisms of the longitudinal alignment assisting portion 120. FIG. 5 is a side view illustrating the longitudinal alignment assisting portion 120. Incidentally, the perspective view of FIG. 4 shows the longitudinal alignment assisting portion 120 viewed from the rear side (that is, IN-side) of the processing apparatus. FIG. 5 shows the longitudinal alignment assisting portion 120 viewed from the front side (that is, OUT-side) of the processing apparatus. In the longitudinal alignment assisting portion 120, a paddle motor 129 is driven with timing, with which paper sheets are discharged, so as to reduce time required for alignment of paper sheets, and as not to disturb the alignment of the paper sheets already aligned on the compiling tray 105. A sub-paddle clutch 127 is driven by this paddle motor 129 and operates. The motion of the paddle motor 129 is interlocked to the link 126 through a first gear 127*a* provided coaxially with this sub-paddle clutch 127, a second gear 127*b* provided in such a way as to mesh with this first gear 127*a*, and a link 128 whose shaft 128*a* is attached to this second gear 127 *b* in such a way as to be offset therefrom. Thus, the sub-paddle 121 attached to this link 128 is caused to operate (that is, perform up-and-down motions). A sub-paddle drive belt 125*a* for causing the sub-paddle 121 to rotate is attached to a gear 125, which is driven by a paddle motor 129, through a shaft (not numbered) and a gear (not numbered).

The assisting portion 120 is controlled so that when paper sheets are discharged from the compiling tray 105, the sub-paddles 121 are moved by this up-and-down motion to the top dead center (that is, an upper position), at which the discharging of a paper bundle is not hindered, and that when a conveyance force is necessary for alignment of paper sheets, the sub-paddles 121 are moved by this up-and-down motion to the bottom dead center (that is, a lower position) so as to increase the conveyance force with necessary timing.

In the longitudinal alignment assisting portion 120, when the number of paper sheets discharged to the compiling tray 105 exceeds a predetermined value (for example, 50), a sub-paddle up/down solenoid 122 is sucked. The link 123 is turned around a center 123*a* in a direction indicated by "(G)" in the figure by the suction of the sub-paddle up/down solenoid 122. The entire portion 120 including the link 124 interlocked therewith and the sub-paddles 121 are moved upwardly (that is, in a direction indicated by "(F)" in the figure). The link 123 is turned around the center 123*a* in a direction indicated by "(H)" in the figure by releasing the sub-paddle up/down solenoid 122. The entire portion 120 including the link 124 interlocked therewith and the sub-paddles 121 are moved downwardly to a height corresponding to a range of the number of discharged paper sheets, which ranges 1 to 50. The height relation between the sub-paddle 121 and the stacked sheets is adjusted to each other in this way. Thus, even when an amount of stacked paper sheets varies, the conveyance force of the sub-paddles 121 can be maintained nearly at a constant value. A paper face regulating guide 126*a* serving as a guide member is provided on the bottom of the link 126 of the longitudinal alignment assisting portion 120. Thus, even when a conveyance force being larger than a predetermined value is provided by the sub-paddle 121 to paper sheets, the paper sheets are prevented from being buckled.

Next, a paper-bundle supporting/discharging portion 130 is described hereinbelow.

The paper-bundle supporting/discharging portion 130 has an eject roll 131, which is pushed against an opposed roll 139, for supporting paper sheets and for discharging paper bundles, and also has a pressing roll 132 for pressing down a part in the vicinity of a folded portion of a Z-folded sheet. This pressing roll 132 is provided at the side in a compiling direction from the eject roll 131 (that is, at the side opposite to the discharging direction), and configured in such a way as to be able to press down a part in the vicinity of a folded portion of paper of A4 size, which is obtained by Z-folding paper of A3 size (that is, the paper size thereof is A3 SEF (Short Edge Feed)). Each of the eject roll 131 and the pressing roll 132 turns around the center of turn 137.

Figure 6:
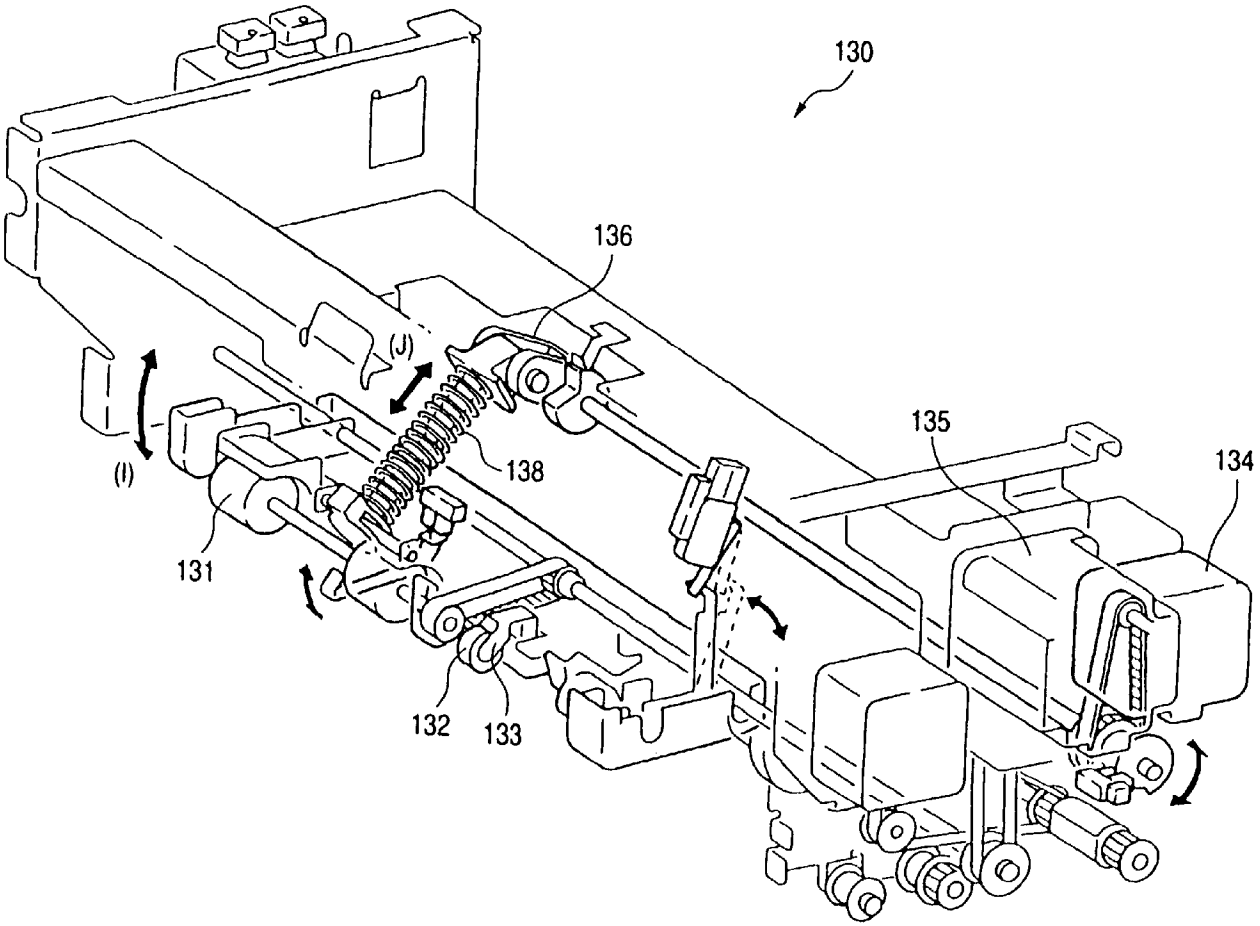
FIG. 6 is a perspective view illustrating each of the mechanisms of the longitudinal alignment assisting/discharging portion.

FIG. 6 is a view illustrating each of the mechanisms of the paper bundle supporting/discharging portion 130. The paper bundle supporting/discharging portion 130 has an eject/clamp motor 134 for causing the eject roll 131 and the pressing roll 132 to perform up-and-down motions, and also has an eject motor 135 for causing the eject roll 131 to turn. The pressing roll 132 is supported by a leaf spring 133. The link 136 is turned by rotation of the eject/clamp motor 134. Thus, the eject roll 131 and the pressing roll 132 are caused to descend and ascend in a direction indicated by "(I)" shown in FIG. 5 around the center of turn 137.

The eject motor 135 causes the eject roll 131 to turn to thereby discharge paper sheets, which are stapled by the stapling mechanism portion, in the discharging direction. The eject motor 135, to which this embodiment of the invention is applied, causes the eject roll 131 to reverse so as to convey sheets in the compiling direction, which is opposite to the discharging direction, with timing with which a paper sheet is first conveyed to an empty compiling tray 105 after the paper bundle is discharged.

The paper bundle supporting/discharging portion 130 pushes paper sheets by using a predetermined pressing force of the spring 138. At that time, the compressing or stretching direction of the spring 138 does not coincide with the direction of movement of the eject roll 131 (that is, a direction indicated by "(I)" in this figure). Thus, change in the pressure applied to the eject roll 131 is alleviated by compressing or stretching the spring 138. Consequently, the pressing force of the eject roll 131, which is applied to paper sheets, can be prevented from largely changing according to an amount of paper to be stacked.

Next, the transversal alignment portion 140 is described hereinbelow.

The transversal alignment portion 140 shown in FIG. 2 has a tamper 141, adapted to slide in a direction perpendicular to a paper conveying direction in which paper sheets are conveyed, for performing a transversal alignment operation on paper sheets conveyed to the compiling tray 105 sheet by sheet from, for example, the rear side of the apparatus to the front side thereof, a tamper motor 142 serving as a driving force source for causing the tamper 141 to perform reciprocating motions, and a belt 143 for transmitting a driving force of the tamper motor 142.

Figure 7:
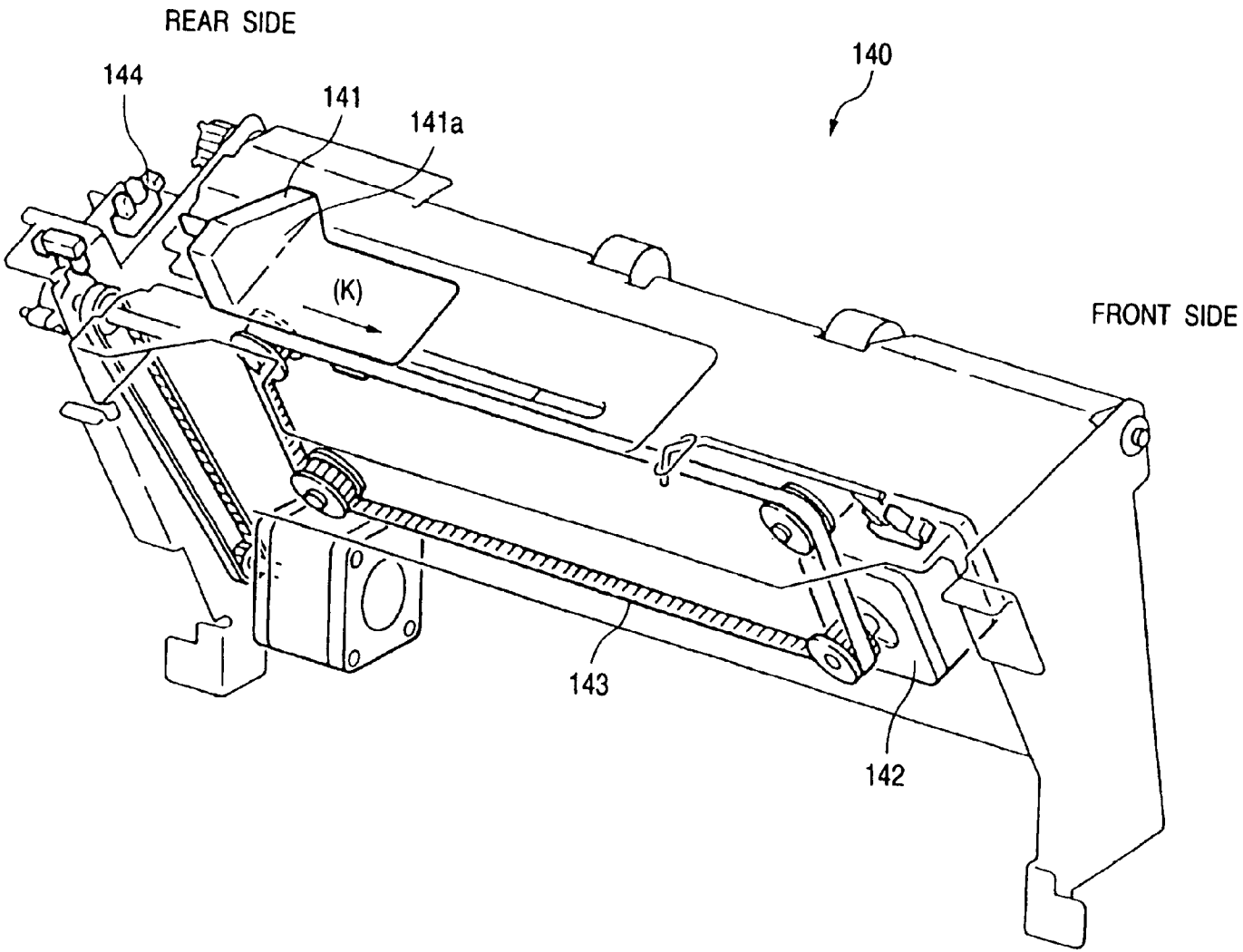
FIG. 7 is a perspective view illustrating each of mechanisms of a lateral alignment portion.

FIG. 7 is a perspective view illustrating each of mechanisms of the transversal alignment portion 140. The transversal alignment portion 140 has a tamper home sensor 144, which is a photosensor for detecting the home position of the tamper 141. The tamper 141 is in a standby state at the home position detected by this tamper home sensor 144. The home position of the tamper 141 is located at the rear side of the apparatus. The tamper 141 functions in such a way as to press a side edge of a paper sheet against a transversal reference wall (not shown) placed at the front side of the apparatus. Independent of the position of the tamper home sensor 144, this standby position is close to the front side when the size of the paper sheet is small. In such a case, the standby position is determined by a stepping control operation performed on the tamper motor 142. In the case of transversal alignment, the tamper motor 142 rotates in synchronization with the conveyance of paper sheets to the compiling tray 142. As the belt 143 turns, the tamper 141 moves in a direction indicated by "(K)" in this figure from the standby position thereof determined according to the size of paper. This movement operation enables the transversal alignment of the paper sheets conveyed to the compiling tray 105. Practically, the alignment of paper sheets on a transversal reference wall (not shown) is performed by pushing a wall portion 141*a*, which is a pushing surface provided on the tamper 141, against the side edges of paper sheets.

Next, the end wall portion 150 is described hereinbelow.

Figure 8:
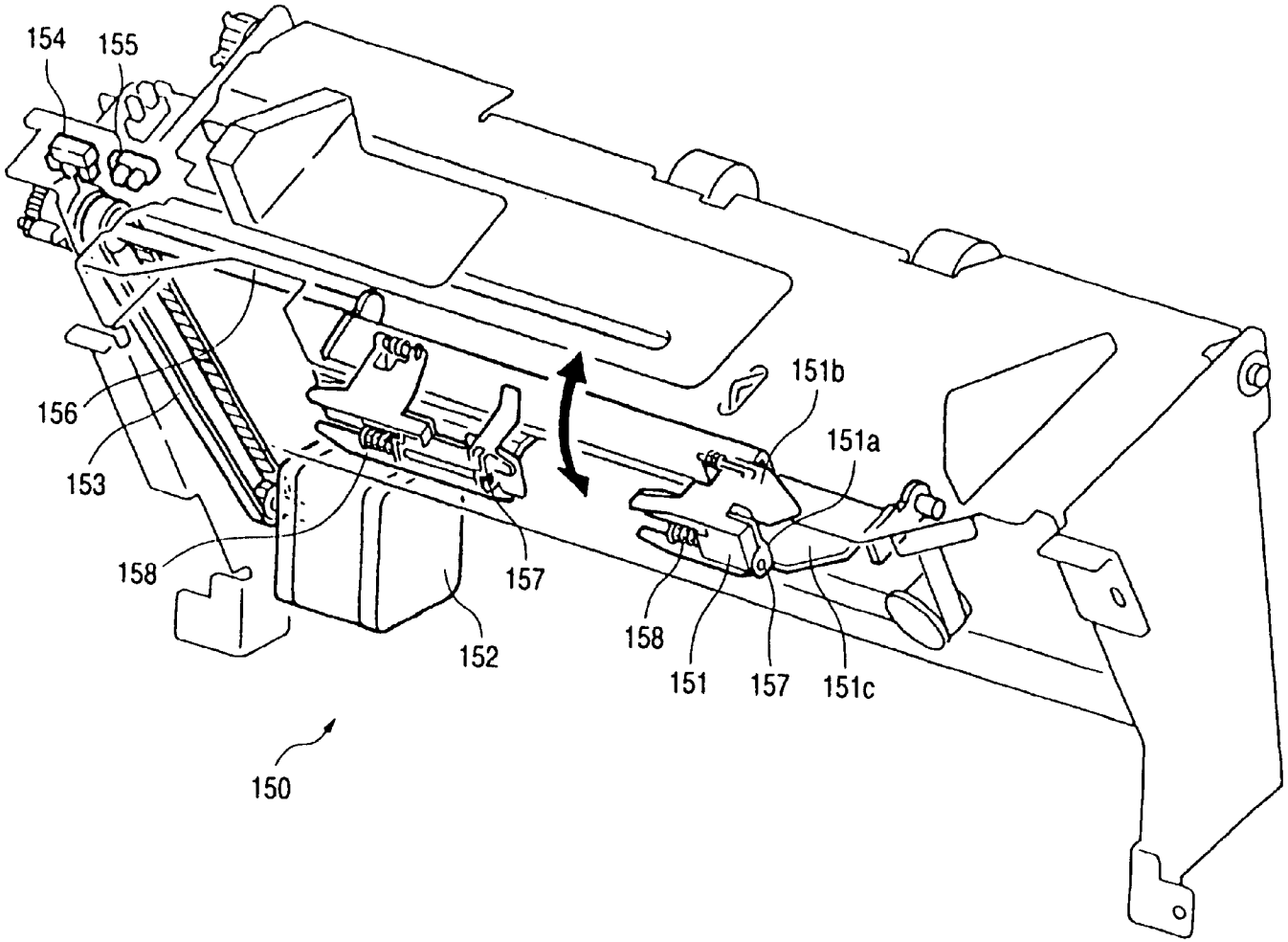
FIG. 8 is a perspective view illustrating each of an end wall portion.

FIG. 8 is a perspective view illustrating each of mechanisms of the end wall portion 150. The end wall portion 150 has an end wall 151 serving as a reference for longitudinal alignment, and aligns paper sheets in a (longitudinal) reference position for stapling. The end wall portion 150 also has an end wall motor 152, which is a stepping motor serving as a driving force source for retracting (or opening) the end wall 151, and further has a belt 153 for transmitting a driving force of the end wall motor 152, an end wall home sensor 154 that is a photosensor for detecting a closed state of the end wall 151, an end wall open sensor 155 that is a photosensor for detecting an opened state of the end wall 151, a shaft 156, which is driven by the belt 153, for opening and closing the end wall 151, a central shaft 157 serving as a center of turn of a ceiling portion 151*b* of the end wall 151, and a spring 158, which is provided in the wall portion 151*a*, for restoring the opened ceiling portion 151*b* to an initial state thereof.

Incidentally, there are two selectable modes of a stapling operation, that is, one is a single mode (or single position stapling mode) in which a stacked paper bundle is stapled at one corner thereof. The other is a dual mode (or two-position stapling mode) in which the paper bundle is stapled at plural positions. In this single mode (that is, the single position stapling mode), the end wall 151 does not retract. In the dual mode (that is, the two-position stapling mode), the end wall 151 interferes with a stapling operation. Therefore, it is necessary to retract the end wall 151 from the stacking face of the compiling tray 105. When the end wall 151 turns so as to retract therefrom, the ceiling portion 151*b* is pushed by a paper bundle. Then, the ceiling portion 151*b* is opened through the central shaft 157. When the contact between the paper bundle and the ceiling portion 151*b* is lost, the spring 158 restores the ceiling portion 151*b*, which constitutes an L-shaped portion together with the wall portion 151*a*, into an original state. Thus, a U-shaped portion can be formed from the wall portion 151*a*, the ceiling portion 151*b*, and a bottom portion 151*c*. Reception of paper sheets to be next compiled is enabled by returning the end wall 151 to an initial position thereof.

Next, the stapling mechanism portion 160 is described hereinbelow.

Figure 9:
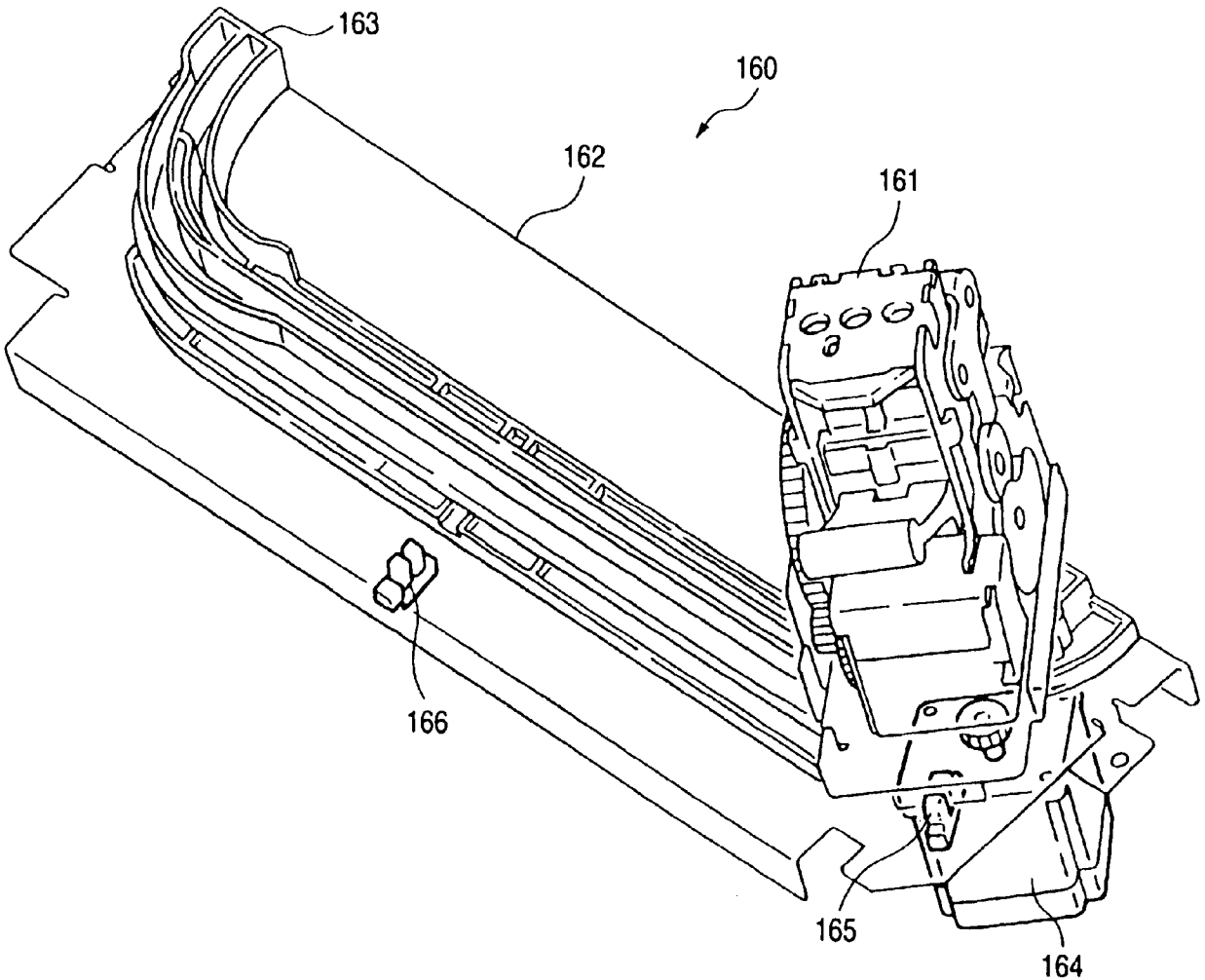
FIG. 9 is a perspective view illustrating a stapling mechanism portion.

FIG. 9 is a perspective view illustrating a stapling mechanism portion 160. The stapling portion 160 has a stapling head (or stapler) 161 for actually performing stapling, a base 162 for supporting the stapling head 161, a rail 163, formed on the base 162, constituting a path, on which the stapling head 161 moves, a stapling movement motor 164 serving as a stepping motor for moving the stapling head 161, a stapling movement home sensor 165 for detecting the home position of the stapling head 161, and a stapling center position sensor 166 for detecting the center position of the stapling head 161.

When the aforementioned single stapling (that is, the single position stapling) is performed, the stapling head 161 stays at a first home position detected by a stapling movement home sensor 165. Then, the stapling head 161 sequentially performs stapling operations with necessary timing. On the other hand, when the dual stapling (that is, the two-position stapling) is performed, the stapling head 161 functions as follows. That is, the stapling head 161 first stands by at a second home position detected by a stapling center-position sensor 166. Thereafter, a bundle of paper sheets is stacked on the compiling tray 105. Then, the stapling movement motor 164 is driven after the end wall 151 is opened. Subsequently, the stapling head 161 is moved to a stapling position, whereupon the head 151 performs two-position stapling.

Next, the shelf mechanism portion 170 is described hereinbelow.

Figure 10:
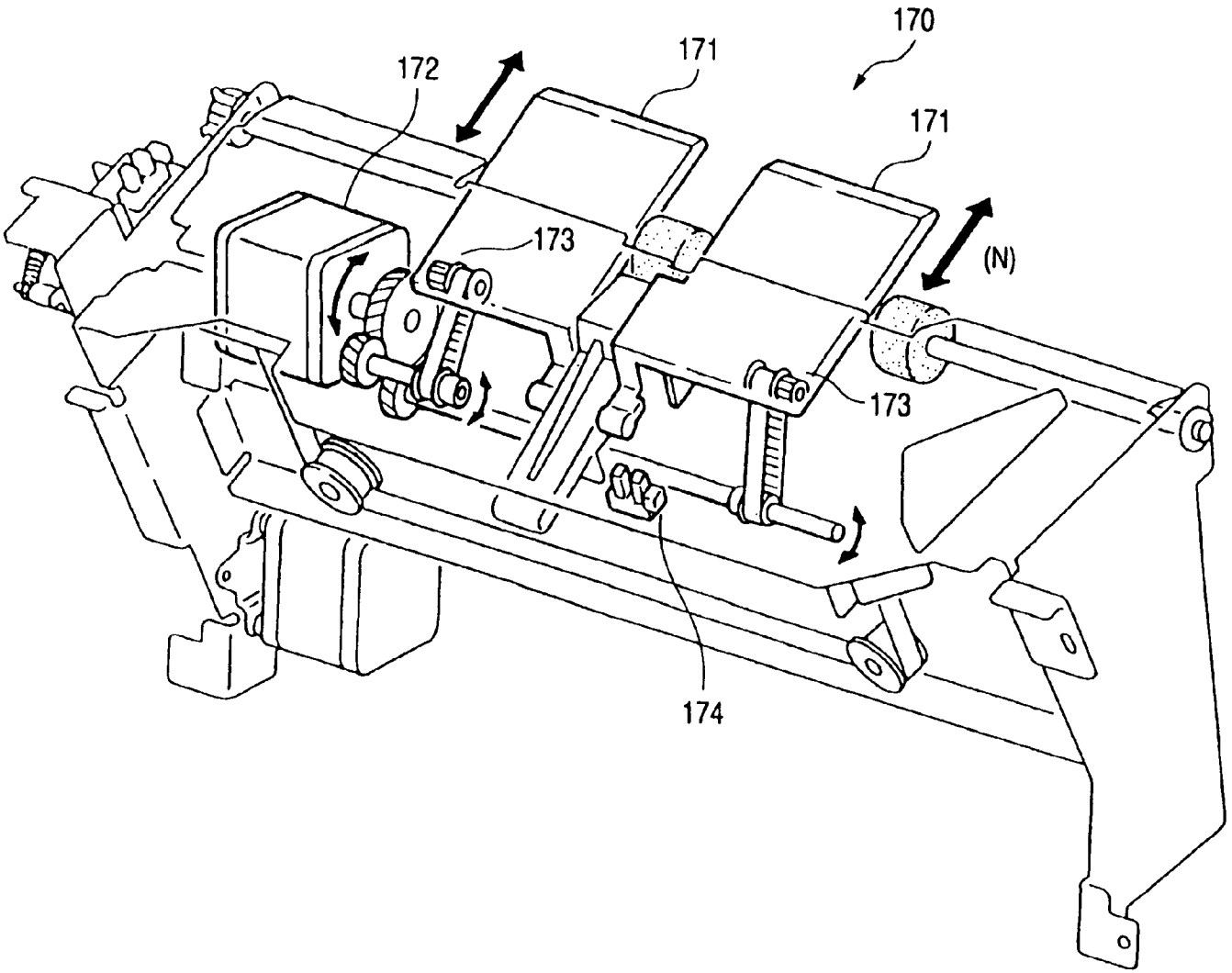
FIG. 10 is a perspective view illustrating a shelf mechanism portion.

FIG. 10 is a perspective view illustrating the shelf mechanism portion 170. The shelf mechanism portion 170 has a shelf 171 serving as a guide for supporting paper sheets in the compiling tray 105, a shelf motor 172 serving as a stepping motor for driving this shelf 171, a rack and pinion mechanism 173 adapted to receive a driving force from the shelf motor 172 and to cause the shelf 171 to slide in a direction indicated by "(N)" shown in this figure, and a shelf home sensor 174 that is a photosensor for detecting the home position of the shelf 171.

This shelf 171 needs to have a predetermined length in the paper conveying direction (that is, the paper discharging direction) so as to support paper sheets in the compiling tray. When an end of the compiling tray 105 having the predetermined length is used as a discharging port, a discharging tray shown in FIG. 2 largely protrudes from the sheet processing apparatus 2. Thus, the shelf 171 is configured in such a way as to be withdrawn in a direction opposite to the paper discharging direction when a paper bundle is discharged. Consequently, the miniaturization of the apparatus is enabled.

Next, a sequence of operations of the stapling function portion 10 described by referring to FIGS. 1 to 10 is described hereinbelow with reference to these figures.

A paper sheet on which an image is formed, is supplied from an image forming apparatus 1 through conveying guides 101 and 102 to the compiling tray 105 by a conveying roller pair 104 constituting a paper discharging means. Compiling paddles 111 of the longitudinal alignment portion 110, which constitute first putting-aside unit, and sub-paddles 121 of the longitudinal alignment assisting portion 120, which constitute second putting-aside unit (sheet putting-aside unit), move supplied paper sheets aside toward the end wall 151 serving as a longitudinal reference wall. At that time, the tampers 141 of the transversal alignment portion 140, which constitute the transversal alignment unit, put the paper sheets a side toward a transversal reference wall (not shown) provided at, for example, the front side of the compiling tray 105. The paper sheets are orderly collected on the top surface of the compiling tray 105 by repeating this operation.

The longitudinal alignment portion 110 constituting the longitudinal alignment unit always causes the compiling paddle 111 to rotate, and to abut against the top surface of the paper sheet supplied to the compiling tray 105 thereby to push the back end side edge (that is, the rear edge) of the paper sheet against the end wall 151. At that time, as described above, when the thickness of the paper sheets stacked on the compiling tray 105 is equal to or more than a predetermined thickness (for example, when the thickness thereof exceeds a total thickness of 50 sheets), the compiling paddle up/down solenoid 112 is activated, and the compiling paddles 111 are raised. Consequently, the conveyance force of each of the compiling paddles 111 can be maintained in an appropriate condition.

On the other hand, as illustrated by referring to FIGS. 4 and 5, in the longitudinal alignment assisting portion 120, the sub-paddle 121 (that is, a pressing member or a pushing member) is moved from a top dead center (that is, a retracting position) to a bottom dead center (that is, an advancing position). The sub-paddle 121 always rotate right-handedly (or clockwise), as viewed in FIG. 2. As the sub-paddle 121 moves to the bottom dead center, the sub-paddle 121 assists a longitudinal alignment operation of pushing paper sheets against the end wall 151. Simultaneously, the sub-paddle 121 presses paper sheets stacked on the compiling tray 105. Consequently, the alignment of paper sheets already stacked on the compiling tray 105 from being disturbed by a paper sheet newly supplied thereto. When paper sheets stacked on the compiling tray 105 has a thickness that is thicker than a predetermined thickness (for instance, when the number of paper sheets exceeds 50), the sub-paddle up/down solenoid 122 is activated to thereby raise the position of the bottom dead center of the sub-paddle 121. Thus, a conveyance force of the sub-paddle 121 can be maintained in an appropriate condition.

Figure 11B:
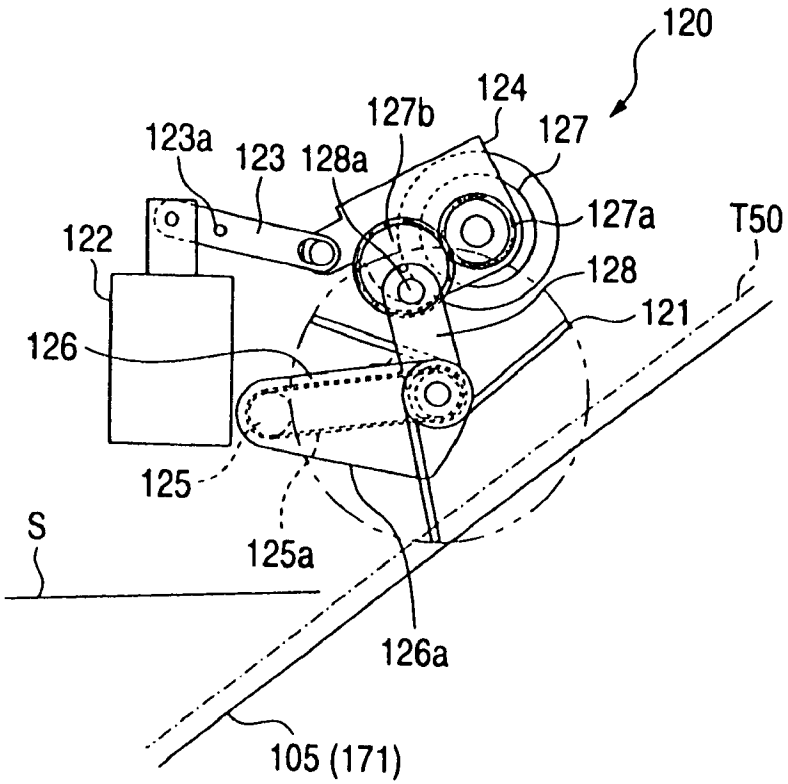
FIGS. 11A and 11B are explanatory views illustrating an operation of the longitudinal alignment assisting portion.
Figure 11A:
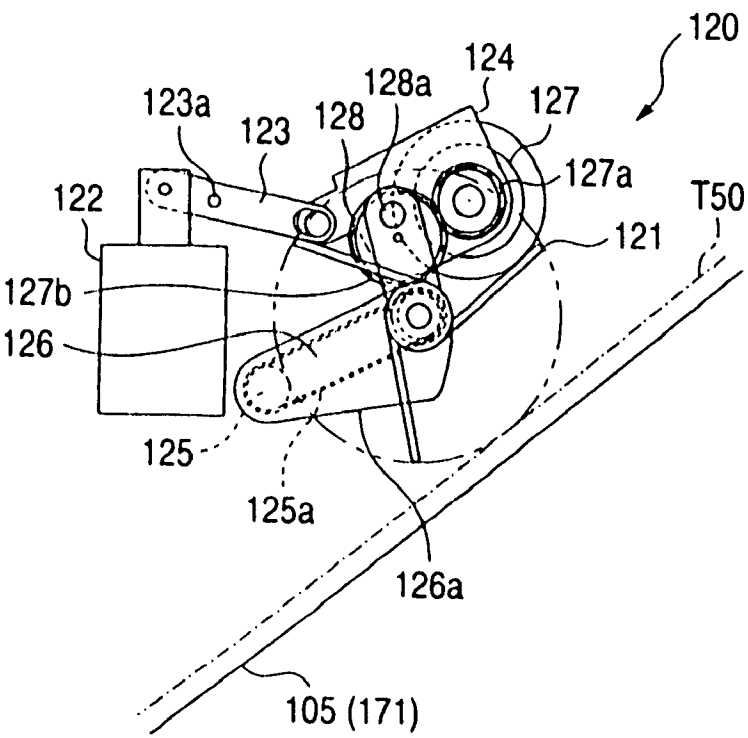

Incidentally, FIGS. 11A and 11B are explanatory views each illustrating an operation of the longitudinal alignment assisting portion 120 in the case that the number of paper sheets stacked in the compiling tray 105 is equal to or less than 50. FIG. 11A illustrates such an operation in the case that the sub-paddle 121 is placed at the top dead center (that is, the retracting position). FIG. 11B illustrates such an operation in the case that the sub-paddle 121 is placed at the bottom dead center (that is, the advancing position). This embodiment features that the top and bottom dead centers of the sub-paddle 121 in the state shown in each of FIGS. 11A and 11B differ from those of the sub-paddle 121 in the state shown in each of FIGS. 12A and 12B, respectively. Incidentally, in each of FIGS. 11A to 12B, a height T50 of 50 sheets stacked on the compiling tray 105 (that is, the shelf 171) is indicated by an imaginary line.

When no paper is newly supplied to the compiling tray 105, the sub-paddle 121 is placed at the top dead center, as illustrated in FIG. 11A. Thus, the sub-paddle 121 retracts to a position at which the sub-paddle 121 does not touch paper sheets stacked on the compiling tray 105, that is, the position at which the trajectory of movement of an end portion of the sub-paddle 121 does not touch the imaginary line indicating the height T50.

When a new paper sheet S is supplied to the compiling tray 105, the sub-paddle 121 moves to the bottom dead center and advances to the position at which the sub-paddle 121 touches the paper sheets (1 to 50 sheets), that is, the position at which the trajectory of movement of an end portion of the sub-paddle 121 touches the stacking face of the compiling tray 105, as illustrated in FIG. 11B. Incidentally, in the case illustrated in FIG. 11B, the trajectory of movement of the sub-paddle 121 penetrates through the compiling tray 105. However, practically, the sub-paddle 121 is deformed by an elastic force, so that the trajectory goes along the surface of the paper sheet stacked on the compiling tray 105. The sub-paddle 121 moves to the bottom dead center and holds down the paper sheets already stacked on the compiling tray 105 before the leading edge of the new paper sheets supplied to the compiling tray 105 touches the paper sheets already stacked thereon. A collision of the new sheet S and the paper sheets stacked on the compiling tray 105 prevents the alignment of the paper sheets from being disturbed. Especially, in this embodiment, the sub-paddle 121 is adapted to rotate clockwise, as viewed in these figures. Thus, the topmost one of the paper sheets stacked on the compiling tray 105 is pushed in a direction opposed to a supplying direction in which the new sheet S is supplied (that is, pushed against the end wall 151). Consequently, the alignment of the paper sheets can be more effectively prevented from being disturbed. The sub-paddle 121 is separated from the paper sheets before the rear edge of the new sheet S falls to the compiling tray 105. Consequently, the new paper S and the paper sheets are not prevented from being aligned on the compiling tray 105.

Figure 12B:
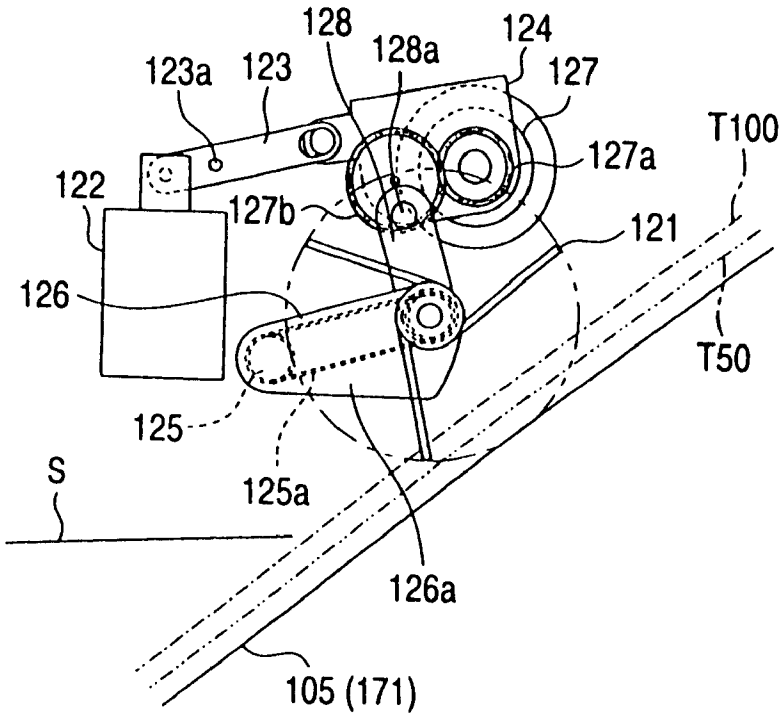
FIGS. 12A and 12B are explanatory views illustrating an operation of the longitudinal alignment assisting portion.
Figure 12A:
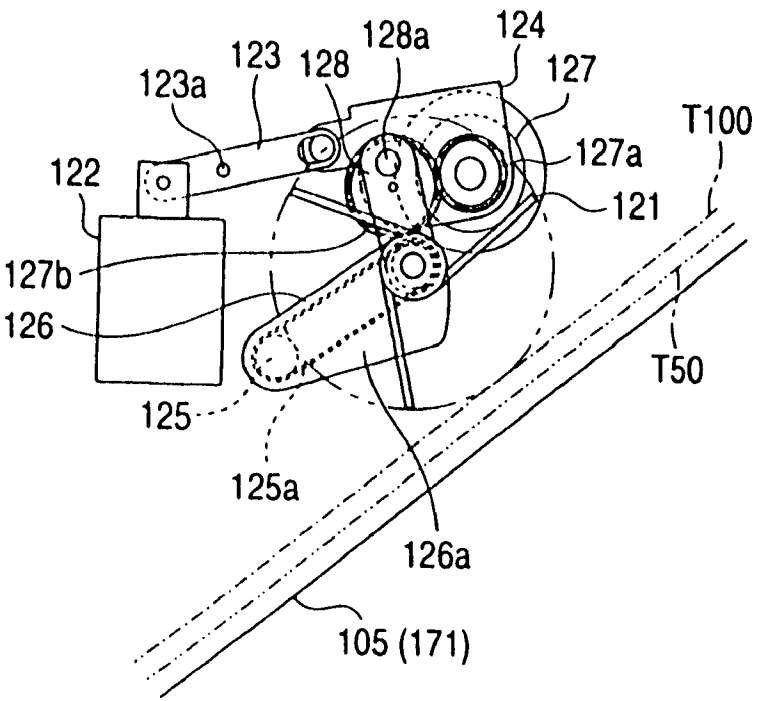

On the other hand, FIGS. 12A and 12B are explanatory views each illustrating an operation of the longitudinal alignment assisting portion 120 in the case that the number of paper sheets stacked on the compiling tray 105 ranges from 51 to 100. FIG. 12A illustrates such an operation in the case that the sub-paddle 121 is placed at the top dead center (that is, the retracting position). FIG. 12B illustrates such an operation in the case that the sub-paddle 121 is placed at the bottom dead center (that is, the advancing position). Incidentally, in each of FIGS. 12A and 12B, a height T100 of 100 sheets stacked on the compiling tray 105 (that is, the shelf 171) is indicated by an imaginary line, in addition to the height T50 of 50 sheets stacked on the compiling tray 105.

During a state in which no paper is newly supplied to the compiling tray 105, the sub-paddle 121 is placed at the top dead center, as illustrated in FIG. 12A. Thus, the sub-paddle 121 retracts to a position at which the sub-paddle 121 does not touch paper sheets stacked on the compiling tray 105, that is, the position at which the trajectory of movement of an end portion of the sub-paddle 121 does not touch the imaginary line indicating the height T100.

When a new paper sheet S is supplied to the compiling tray 105, the sub-paddle 121 moves to the bottom dead center and advances to the position at which the sub-paddle 121 touches the paper sheets (51 to 100 sheets), that is, the position at which the trajectory of movement of an end portion of the sub-paddle 121 touches the stacking face of the compiling tray 105, as illustrated in FIG. 12B. Therefore, in this case, when a sheet S is newly supplied thereto, the alignment of paper sheets already stacked on the compiling tray 105 can be prevented from being disturbed, similarly with the case that the number of the sheets ranges from 1 to 50.

Incidentally, when a paper sheet is supplied thereto, the transversal alignment portion 140 constituting the transversal alignment unit stands by at a size position located more inwardly than the back edge of the supplied paper sheet. The standby position is either the home position shown in FIG. 7 as described above, or a position located closer to the front than the home position in the case of conveying a paper sheet whose length in a main scanning direction (that is, a length in a direction perpendicularly to the paper conveying direction) is short. After the rear edge of the paper sheet is discharged by the conveying roller pair 104, the tamper 141 moves in the direction of a transversal reference wall and stops at a position at which (the distance from the transversal reference wall to the tamper 141) (the length in the main scanning direction). Thereafter, the transversal alignment portion 140 returns to the size position again. The transversal alignment of the sheets is enabled by repeatedly performing this operation each time when a paper sheet is supplied to the compiling tray 105.

Subsequently, after paper sheets of the necessary number constituting a paper bundle are stacked and aligned, the eject/clamp motor 134 (see FIG. 6) of the paper bundle supporting/discharging portion 130 operates. The pressing roll 132 and the eject roll 131 fall and abut on the paper sheet face, and hold and support a paper bundle. The sub-paddle 121 (see FIG. 5) retracts to the top dead center and goes apart from the paper bundle. In the case of the single mode (that is, the single-position stapling mode), a stapling motor (not shown) provided in the stapling head 161 is activated and performs stapling on the paper bundle. Thereafter, the eject motor 135 (see FIG. 6) rotates, so that the eject roll 131 rotates in the discharging direction. Thus, the paper bundle (or a brochure) is discharged toward the discharging tray 109. At that time, in the shelf mechanism portion 170, the shelf motor 172 shown in FIG. 10 is activated and causes the shelf 171 to slide in the direction in which the shelf 171 is withdrawn.

On the other hand, in the dual mode (that is, the two-position stapling mode), the pressing roll 132 and the eject roll 131 fall, so that a paper bundle is pressed and supported. Subsequently, the end wall motor 152 (see FIG. 8) of the end wall portion 150 operates. Thus, the end wall 151 is turned, so that the end wall 151 retracts from the compiling tray 105. Incidentally, in the case of the dual mode (that is, the two-position stapling mode), the stapling head 161 stands by at the position of the stapling center-position sensor 166 (see FIG. 9). After the end wall 151 retracts, the stapling movement motor 164 (see FIG. 9) of the stapling mechanism portion 160 is driven. Thus, the stapling head 161 is moved to the stapling position, whereupon two-position stapling is performed thereon. Thereafter, a paper bundle (that is, a brochure) is discharged to the discharging tray 109, similarly with the case of the single mode (that is, the single position stapling mode).

Incidentally, although the paper sheets already stacked on the compiling tray 105 is held in this embodiment by causing the sub-paddle 121 to perform up-and-down motions at each time when a paper sheet is supplied thereto, paper sheets disturbing the alignment of paper sheets are pliant paper sheets, such as a z-folded paper sheet and a cardboard. Thus, the pressing by the sub-paddle 121 may be permitted only in the case that a paper sheet newly supplied to the compiling tray 105 is a pliant paper sheet. To describe concretely, such a case is, for example, the cases that the folding processing is designated by a user, that the apparatus stores information, which indicates that cardboards are accommodated in a paper sheet tray (not shown) which a user designated from a plurality of paper sheets, as tray information, and that cardboards are designated by a user.

As described above, the aforementioned configuration of the stapling function portion 10 enables the alignment and stapling of a predetermined number of paper sheets. However, sometimes, a post-processing time becomes long, because a stapling operation of the stapling function portion 160—and a transversal alignment operation of the transversal alignment portion 140 are performed. Thus, before the stapled sheet bundle is discharged from the compiling tray 105, the next paper sheet to be compiled is supplied thereto. For example, in the transversal alignment portion 140, the tamper 141 is moved twice when the last transversal alignment is performed after the last paper sheet is supplied thereto. That is, the tamper 141 is returned once after advanced once, and then operated in such a way as to pat the paper sheets. Consequently, the quality of transversal alignment of the paper sheets is enhanced. When such a function is employed, a long time is required for transversal alignment. However, it is not preferable to reduce the productivity of the entire apparatus. Therefore, this embodiment is configured so that a buffer portion for laying paper sheets one on top of another to spend time is provided on a conveyance path prior to a stage for supplying paper sheets to the compiling tray 105.

Figure 14:
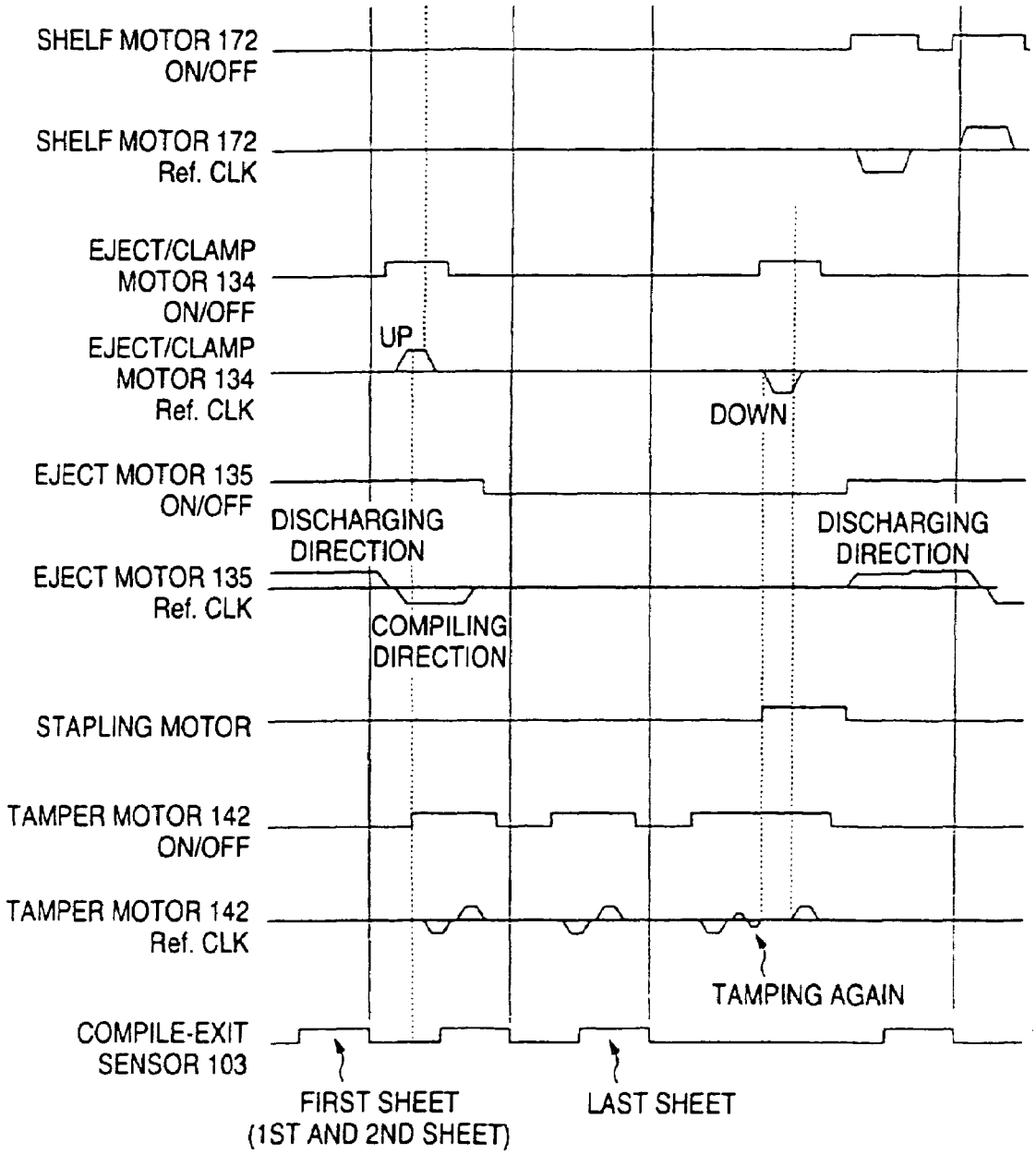
FIG. 14 is a timing chart illustrating an operation of a stapling function portion in the case of selecting a single mode (that is, a single-position stapling mode)

FIG. 14 is a timing chart illustrating an operation of the stapling function portion 10 in the case of selecting the single mode (that is, the single-position stapling). This portion 10 is controlled by the controller 7. At the bottom of FIG. 14, timing, with which the compile-exit sensor 103 operates when paper sheets are supplied to the compiling tray 105, is illustrated. In the case of employing what is called a buffer compiling method, first and second paper sheets are supplied to the compiling tray 105 with first timing. The eject roll 131 of the paper bundle supporting/discharging portion 130 constituting the paper bundle discharging/sandwiching means, together with the opposed roll 139, receives the paper sheets laid one on top of another from the conveying roll pair 104. After the rear edge of the paper sheet goes out of the conveying roll pair 104, the eject roll 131 and the opposed roll 139 are reversed in a compiling direction opposite to the discharging direction. Thus, what is called a reversing operation is performed. This reversing operation enables the enforced conveyance of the rear edge of the paper sheet, which are scratched down on the bottom surface of the compiling tray 105, to the end wall 151 serving as the longitudinal reference wall.

Subsequently, when the rear edge of the paper sheet almost reaches the position at which the compiling paddles 111 are in contact with the bottom surface of the compiling tray 105, the eject clamping motor 134 is turned off, as illustrated in FIG. 14. The eject roll 131 finishes to sandwich the paper sheet. The apparatus is controlled in this manner. The tamper 141 is slide-moved by the tamper motor 142 moving in synchronization with the finish of the sandwiching of the paper sheet by the eject roll 131. Thus, the paper sheet is drawn to the transversal reference wall. Thereafter, the transversal alignment portion 140 serving as the transversal alignment unit stops at a position at which the following inequality is satisfied:

$$D1 \leqq D2$$

where D1 denotes a distance from the transversal reference wall to the surface of the tamper 141, and D2 designates in a direction perpendicular to a paper conveying direction of the supplied paper sheet. Subsequently, the transversal alignment portion 140 performs a stapling operation of the stapling head 161, which is driven by the stapling motor, on the paper sheets. Then, an operation of returning the transversal alignment portion 140 is performed.

Incidentally, after the last paper sheet is supplied, the tamper motor 142 causes the tamper 141 to go away from the edge of the paper sheet by a predetermined distance. Thereafter, the tamper 141 is moved to the edge of the paper sheets again. Then, the tamping is performed once again. That is, the tamper 141 is controlled as follows. After the tamper 141 stops at the position at which the inequality $D1 \leqq D2$ is met, the tamper 141 goes away from the reference wall once so that another inequality $D1 > D2$ is satisfied. Then, the tamper 141 moves again to the position at which the inequality $D1 \leqq D2$ is satisfied. Subsequently, stapling is performed. Consequently, the quality of alignment of paper sheets upon supply of the last paper sheet can be enhanced.

Upon completion of stapling in this way, the eject clamping motor 134 is turned on. Thereafter, the eject roll 131 is moved to the paper bundle sandwiching position, and the paper bundle is discharged. At that time, the shelf motor 172 is activated. Thus, the shelf 171 is retracted. Then, after the paper bundle is discharged, the shelf 171 is caused to advance and stand by to compile the next paper sheet supplied to the compiling tray 105.

Next, an operation of the longitudinal alignment portion 110, which is a feature of this embodiment, is described in detail hereinbelow.

Figure 15A:
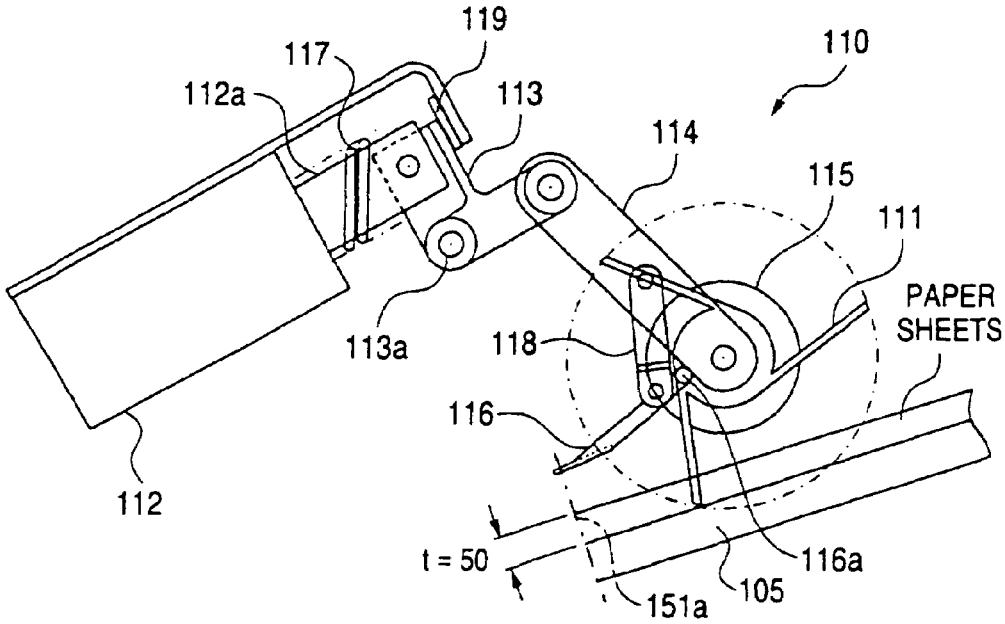
FIGS. 15A and 15B are explanatory views each illustrating a basic up-and-down motions of a longitudinal alignment portion.
Figure 15B:
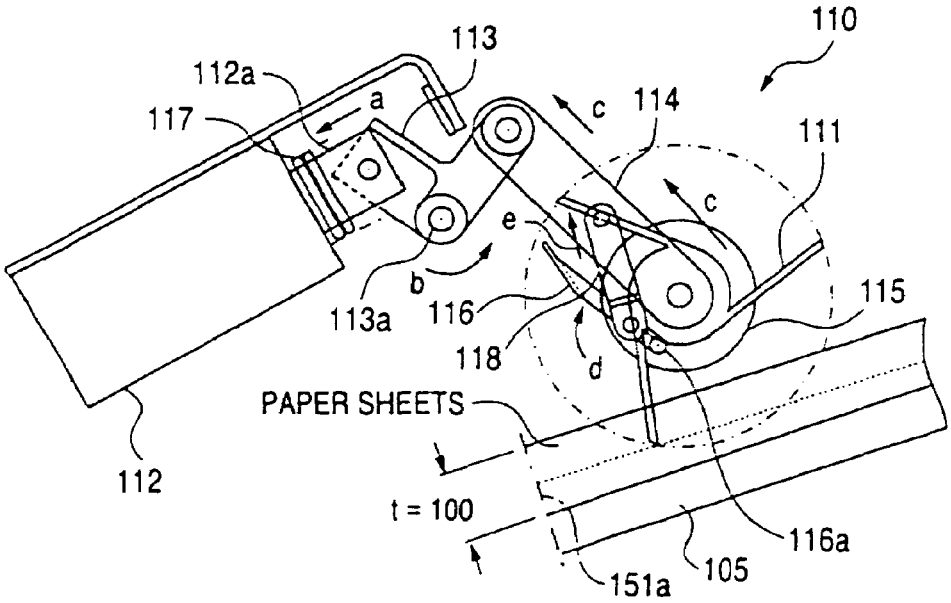

FIGS. 15A and 15B are explanatory views each illustrating basic up-and-down motions of the longitudinal alignment portion 110. The longitudinal alignment portion 110 has the function of pushing the rear edge of each of the paper sheets, which are supplied to the compiling tray 151, against the end wall 151 (see FIG. 2) constituting the longitudinal reference wall, as described above. Thus, the surface of the supplied paper sheet is brought into contact with the compiling paddle 111. The paper sheet is conveyed to the end wall 151 by the conveyance force of the compiling paddle 111 that rotates. Consequently, the longitudinal alignment of paper sheets is enabled. Incidentally, even when the conveyance force of each of the compiling paddles 111 is too large, the paper pushed against a wall portion 151*a* of the end wall 151 is buckled. Conversely, when the conveyance force of each of the compiling paddles 111 is too small, the alignment takes time. Thus, the quality of alignment of paper sheets is lowered. For instance, before the paper sheet is pushed against the wall portion 151*a* of the end wall 151, the next paper sheet is supplied. Therefore, preferably, the paper conveyance force of the compiling paddle 111 is limited within a certain range.

In the case of conventional machines, the number of paper sheets collected in the compiling tray 105 is not very large. Therefore, the paper conveyance force of the compiling paddles 111 does not largely vary. However, when the number of paper sheets collected in the compiling tray 105 becomes very large in such a way as to meet the request for considerably increasing the capacity of a stapler, the thickness of the stacked paper sheets increases, so that the distance between the compiling paddle 111 and the surface of the paper sheet becomes short. Thus, the substantial conveyance force becomes extremely large. Thus, this embodiment is adapted so that the compiling paddles 111 are caused to perform up-and-down motions according to the thickness of a paper bundle stacked on the compiling tray 105. Consequently, the amount of contact between the paper bundle and each of the compiling paddles 111, and the contact pressure caused therebetween are changed. This embodiment is configured so that the compiling paddles 11 are downwardly moved (that is, lowered) and a first state is maintained in the case that the number of paper sheets (plain paper sheets) is equal to or less than 50 (that is, t=50), as illustrated in FIG. 15A. This embodiment is also configured so that the compiling paddles 15 are upwardly moved (that is, lifted) and put into a second state in the case that the number of paper sheets (plain paper sheets) exceeds 50 (that is, t=100), as illustrated in FIG. 15B.

More concretely, the number of paper sheets stacked on the compiling tray 105 is counted by the controller 7 according to a detection signal outputted from the compile-eject sensor 103 shown in FIG. 2. When the counted number of paper sheets reaches 50, the controller 7 issues an operation command to the compiling paddle up/down solenoid 112. In response to the operation command, the compiling paddle up/down solenoid 112 pulls the shaft 12*a* in a direction indicated by "a" in FIGS. 15A and 15B from a state illustrated in FIG. 15A, in which the position is determined by a regulating plate-like member 119, to a state illustrated in FIG. 15B. The movement of the shaft 112*a* causes the link 113 connected thereto to turn around the central shaft 113*a* in a direction indicated by "b" shown in these figures. As this link 113 is turned, the link 114 is moved in a direction indicated by "c" shown in these figures. The movement of the link 114 causes the compiling paddles 111 to similarly move in the direction indicated by "q". Such a movement of the compiling paddles 111, that is, the rise thereof from the compiling tray 105 enables the processing apparatus to stably provide an appropriate conveyance force of each of the compiling paddles 111 even when the number of the stacked paper sheets increases.

Incidentally, when the compiling paddles 111 rise, the first regulating guide 115 and the second regulating guide 116 similarly rise. Because the first regulating guide 115 is provided coaxially with the compiling paddles 111, the first regulating guide 115 performs up-and-down motions by following the up-and-down motions of the compiling paddles 111. As illustrated in FIG. 15A, the second regulating guide 116 is connected to a link 118 extended from apart of the link 114, and has a pivot 116*a* at an end thereof, which is extended from the conveying guide 102 and turns around a predetermined stationary position. As is seen from FIG. 15B, the movement of the link 114 in the direction indicated by "c" causes the link 118 to be pulled in the direction indicated by "d". This movement of the link 118 causes the second regulating guide 116 to turn around the pivot 116*a* in the direction indicated by "d" shown in the figures, so that the second regulating guide 116 is brought into a flipped-up state.

The appropriate conveyance force can be maintained by causing, according to the number of stacked paper sheets, the compiling paddles 111 to perform up-and-down motions and by moving the paddles 111 in the direction of thickness of a paper bundle. However, many paper sheets discharged through a fixing portion of an image forming apparatus 1 are highly curled and corrugated. Thus, even when the number of paper sheets is, for instance, doubled, the thickness thereof is not simply doubled. Especially, in the case that a rear end portion of the paper sheet is highly curled, the thickness thereof may increase 2.5 times when the number of paper sheets is doubled. In such a case, the paper sheets are pushed against the wall portion 151*a* of the end wall 151. Therefore, a considerably large conveyance force is needed. On the other hand, when a large conveyance force is directly applied to the paper sheet pushed against the wall portion 151*a* of the end wall 151, troubles, such as buckling, are liable to occur. A large conveyance force increases a load imposed on a motor (not shown) when the compiling paddles 11 rotate. Thus, when the number of stacked paper sheets becomes equal to or larger than a certain value, this embodiment finely controls the up/down motions of the compiling paddles 111, the first regulating guide 115, and the second regulating guide 116 with timing with which paper sheets are conveyed. Consequently, the quality of alignment of paper sheets is enhanced still more.

Figure 16A:
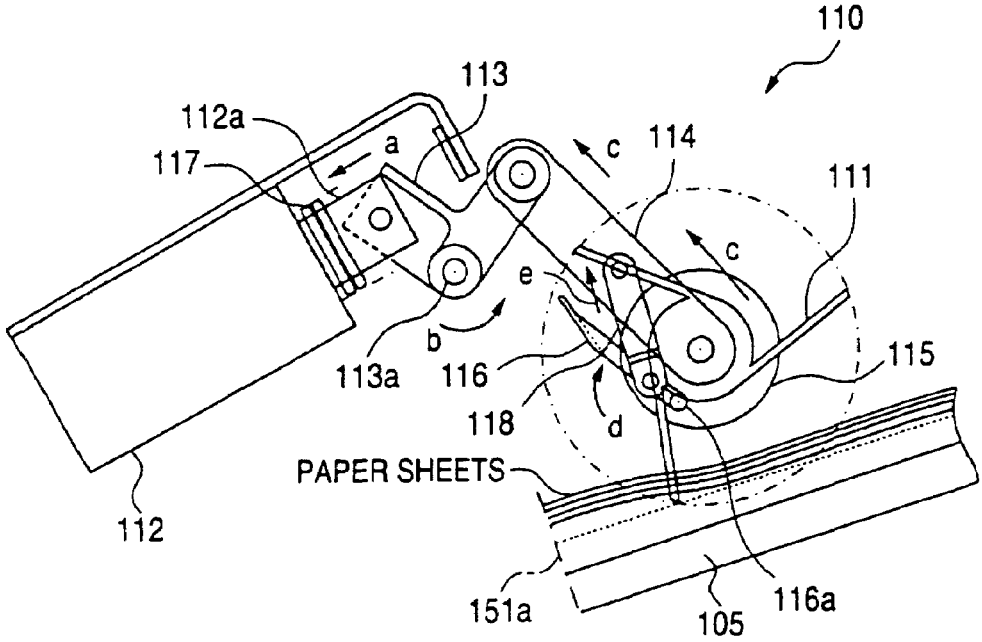
FIGS. 16A and 16B are explanatory views each illustrating up-and-down motions performed in the case that a compiling paddle is shifted into a second state when the number of stacked sheets exceeds a predetermined value.
Figure 16B:
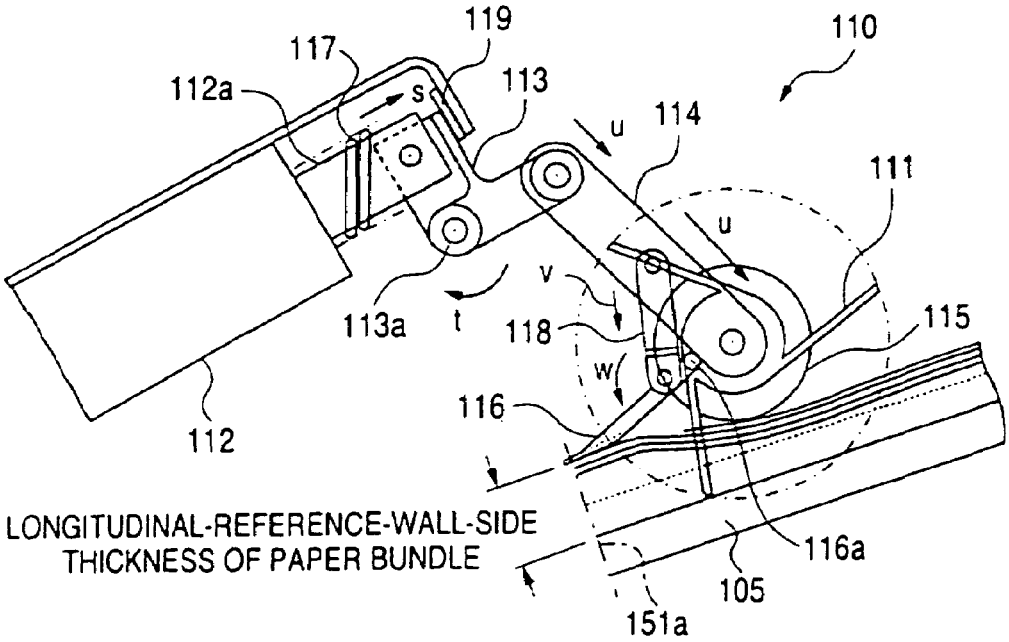

FIGS. 16A and 16B are explanatory views each illustrating up-and-down operations performed when the compiling paddles 11 are brought into the second state in the case that the number of stacked paper sheets exceeds a predetermined value (for example, 50 plain paper sheets). FIG. 16A illustrates the ordinary upward movement thereof in the second state, in which the number of plain paper sheets is equal to or more than 50, and also illustrates a condition in which the compiling paddles 11 are moved to an ordinary paper sheet alignment position (that is, a sheet alignment position). FIG. 16B illustrates the movement thereof to the lower position (that is, a sheet pressing position), which is performed every 5 paper sheets to be stacked. As described with reference to FIGS. 15A and 15B, each of the compiling paddles 111 moves to the upper position shown in FIG. 16A when the number of paper sheets exceeds a predetermined value. Consequently, the conveyance force can be maintained within a predetermined range. However, air enters between adjacent paper sheets owing to the presence of curled parts. Thus, the paper sheets are stacked in a fluffy (or soft) state. Therefore, to fully convey such paper sheets, the state illustrated in FIG. 16B is realized, for instance, every 5 paper sheets. That is, the suction of the compiling paddle up/down solenoid 112 is canceled. The shaft 112*a* is pushed out in a direction indicated by "s" in these figures by stretching the spring 117. The movement of the shaft 112*a* causes the link 113 connected thereto to turn around the central shaft 113*a* in a direction indicated by "t". This turn of the link 113 causes the link 114 to move in a direction indicated by "u" shown in these figures. The movement of the link 114 causes the compiling paddles 111 to move in the direction indicated by "u". Such movement thereof, that is, the movement thereof in a direction, in which the thickness of the paper bundle is reduced, ensures the appropriate conveyance force of the compiling paddles 111 even in case of the paper bundle swollen owing to curly parts thereof.

At that time, in this embodiment, each of the first regulating guide 115 and the second regulating guide 116 moves to the lower position. The first regulating guide 115 is a disk-like member, and disposed coaxially with the axis of rotation of the compiling paddle 111. This first regulating guide 115 rotates during a state in which the guide 115 does not touch the paper sheet (that is, a state illustrated in FIG. 16A) by being driven by the rotation of the compiling paddle 11 by a proper fictional force. During a state in which the guide 115 touches the surface of the paper sheet as shown in FIG. 16B, the guide 115 turns by following the movement of the paper sheet. That is, when the top surface of the paper sheet is in contact with the disk-like outer periphery of the first regulating guide 115, the contact part of the guide 115 changes the speed in such a way as to be nearly equal to the speed of movement of the top surface of the paper sheet. Thus, the first regulating guide 115 is in contact with the paper sheet under a proper pressure obtained by the spring 117. Consequently, the surface of the paper sheet, which is uneven due to the curled parts, can be appropriately pressed by the first regulating guide 115.

An important function of this first regulating guide 115 is to prevent the distance between the surface of the paper sheet and the compiling paddle 111 owing the contact between the guide 115 and the surface of the paper sheet from becoming less than a predetermined constant value. That is, as illustrated in FIG. 15A, when the number of paper sheets stacked on the compiling tray 105 is small (that is, when a small number of sheets are stacked thereon), the lowest position of each of the compiling paddles 111 is determined by the regulating plate-like member 119. Conversely, when an amount of a paper bundle is large (that is, a large number of paper sheets are stacked thereon) and the thickness of the paper bundle increases, the compiling paddles 111 are pushed up by the first regulating guide 115. The lowest position of each of the compiling paddles 111 serving as the longitudinal alignment unit is determined by the first regulating guide 115. Consequently, the positions of the compiling paddles 111 are prevented from being too low with respect to the surface of the paper bundle. Further, what is called a "step-out" phenomenon, that is, loss of synchronization between a control pulse and the rotation of the motor due to overload thereon is restrained from occurring in the motor. The alignment of paper sheets is not impeded by preventing occurrence of overload on the motor.

On the other hand, at the movement of the second regulating guide 116 to the lower position shown in FIG. 16B, which is performed each time 5 sheets are newly stacked, the link 114 moves in the direction indicated by "u" shown in this figure, so that the link 118 is pushed in a direction indicated by "v" shown therein. This movement of the link 118 causes the second regulating guide 116 to turn around the pivot 116*a* in the direction indicated by "w" shown therein. The second regulating guide 116 holds the rear end (that is, the longitudinal-reference-wall-side end) of the paper sheet, and determines the longitudinal-reference-wall-side thickness of the paper bundle. This operation enables alignment of highly curly paper sheets. Incidentally, when the thickness of the paper bundle is larger than a predetermined value, this second regulating guide 116 has to turn. Thus, the second regulating guide 116 pushes up the links 118 and 114 and moves the compiling paddles 111 in a direction in which the paddles 111 go away from the paper bundle. That is, similarly as the first regulating guide 115, this regulating guide 116 determines the lowest position of each of the compiling paddles 111.

Thus, the first regulating guide 115 and the second regulating guide 116 have the function of hitting the paper (or sheet) bundle and restraining the paper bundle, which includes air between the stacked paper sheets, from being flipped up. These guides 115 and 116 undertake a role of regulating the position of each of the compiling paddles 111, that is, as a regulating unit for regulating the position thereof. The regulating unit include the regulating plate-like member 119 for regulating the lowest position of each of the compiling paddles 111. That is, the regulating unit including the regulating plate-like member 119, the first regulating guide 115 and the second regulating guide 116 regulate the positions in a direction of thickness of the sheet of the compiling paddles 111 constituting a sheet conveying unit by using different members according to the thickness of the sheet.

Incidentally, regarding timing, with which the movement of the paddles 111 between the positions shown in FIGS. 16A and 16B is performed, when such movement is performed each time a new sheet is stacked, adverse effects, such as noises, may be caused. Moreover, the power consumption increases. Preferably, such movement is performed each time several sheets (for example, 5 sheets) are serially conveyed so as to highly effectively obtain advantages. Further, the movement of the paddles 111 to the lower position shown in FIG. 16B is performed with predetermined timing with which an nth paper sheet (incidentally, "n" is an integer being equal to or larger than 2) is supplied. The movement of the paddles 111 to the upper position shown in FIG. 16A is performed with predetermined timing, that is, just before the topmost paper sheet (that is, the nth sheet) comes in contact with the second regulating guide 116. Strictly speaking, the up-and-down motions performed with such timing permits the first regulating guide 115 to regulate the behavior of the last one (that is, the nth sheet) of the paper sheets to the compiling tray 105. Alternatively, the first regulating guide 115 may regulate the behavior of the last but one (that is, an (n−1)'th sheet). The second regulating guide 116 regulates the behavior of the last but one (that is, an (n−1)'th sheet) of the stacked sheets, which just precedes the last sheet (that is, the nth sheet). There is no problem caused even when the fist regulating guide 115 regulates the (n−1)'th sheet.

Incidentally, regarding timing with which the movement of the paddles 111 from the upper position (that is, a paper alignment position) shown in FIG. 16A to the lower position shown in FIG. 16B and then return thereof to the upper position (that is, the paper alignment position) shown in FIG. 16A are performed, preferably, the timing is determined so that such operations are finished until the tamper 141 (see FIGS. 2 and 7) constituting one of transversal alignment unit moves the paper sheets aside toward a transversal reference wall (not shown). Such a control operation does not hinder the transversal alignment to be performed by the transversal alignment portion 140. That is, the movement to the upper position shown in FIG. 16A is performed immediately before a paper sheet being discharged (that is, an nth sheet) touches the second regulating guide 116. Further, the movement to the lower position shown in FIG. 16B is performed with timing with which the longitudinal alignment and the transversal alignment to be performed on an (n−1)'th sheet are finished.

The second regulating guide 116 is placed in the proximity of the wall portion 151*a* of the end wall 151 serving as the longitudinal reference wall. When the stapling mechanism portion 160 performs stapling, the second regulating guide 116 effectively functions in the case that the rear end of the paper sheet is highly curled. Each of the first regulating guide 115 and the second regulating guide 116 is disposed at plural places (for instance, 3 to 4 places) arranged in a direction perpendicular to the paper conveying direction in such a manner as to be able to cover nearly the entire compiling tray 105. Consequently, alignment can favorably be performed on rear end portions and (corner) end portions of each paper sheet, which are usually highly curled.

Figure 17:
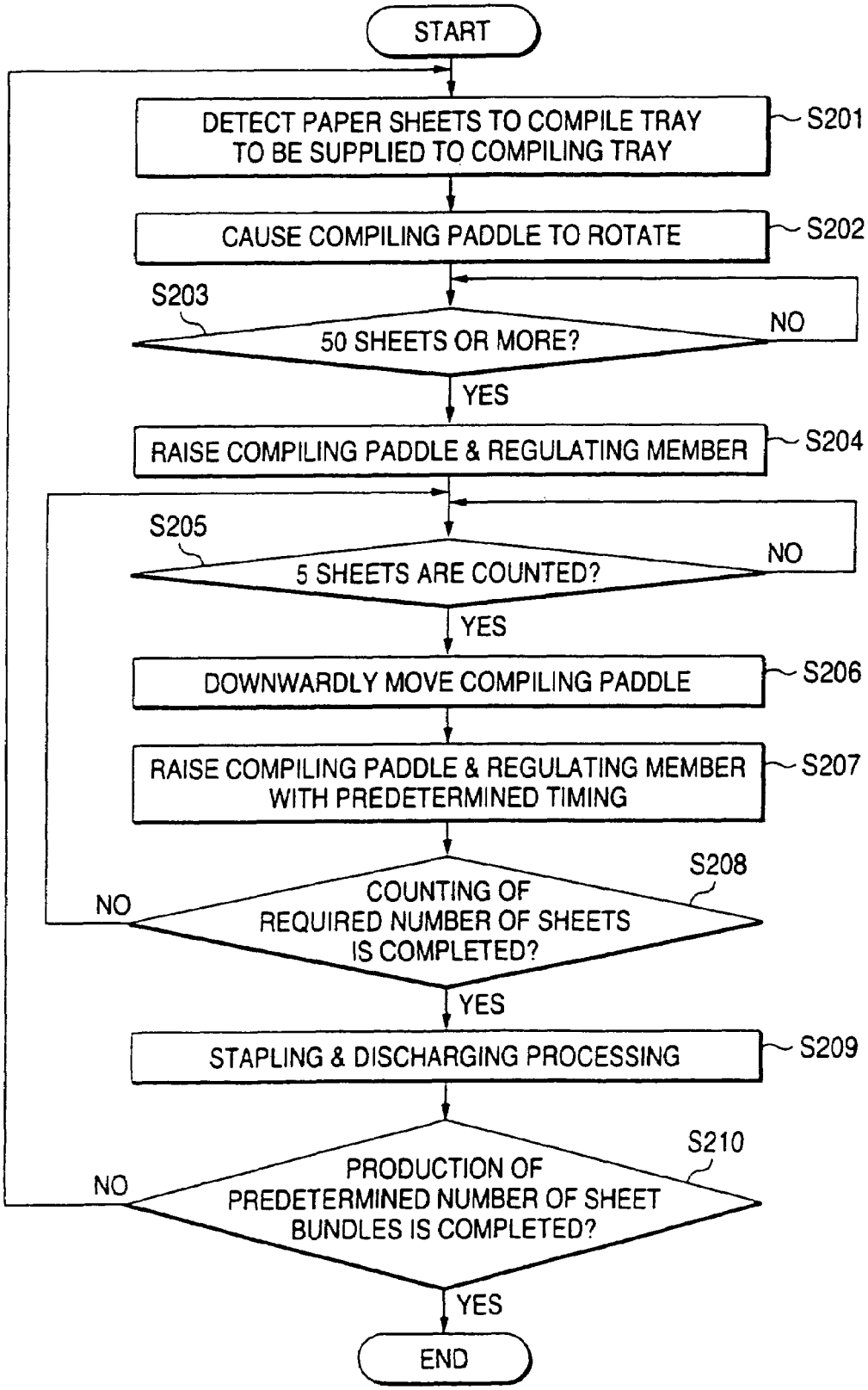
FIG. 17 is a flowchart illustrating processing to be performed at a controller.

FIG. 17 is a flowchart illustrating a process to be performed in the controller 7. In the controller 7, in the case that a designated and predetermined number of stapled brochure are produced, first, a compile-exit sensor 103 detects a paper sheet to be supplied to the compiling tray 105 in step 201. Paper sheets to be supplied to the compiling tray can be counted by utilizing signals sent from this compile-exit sensor 103. The controller 7 causes the compiling paddles 111 with predetermined timing to rotate in step 202. The paddles 111 may be rotated at all times. Thereafter, the controller 7 judges in step 203 whether or not the number of paper sheets supplied to the compiling tray 105 exceeds 50. When the number of paper sheets supplied to the compiling tray 105 is equal to or exceeds 50, the compiling paddles 111, and the regulating members, that is, the first regulating guide 115 and the second regulating guide 116 are raised in step 204. The compiling paddles 111 continues to perform a conveying operation and remains at the lower position until the number of paper sheets reaches 50.

Thereafter, the controller 7 counts sheets of a predetermined number, for instance, 5 in step 205. Upon completion of counting 5 sheets, the compiling paddles 111 and the regulating members, that is, the first regulating guide 115 and the second regulating guide 116 are moved down in step 206. At the lower position, the compiling paddles 111 perform the conveyance of paper sheets. Then, the compiling paddles 111 and the regulating members, that is, the first regulating guide 115 and the second regulating guide 116 are lifted in step 207 with predetermined timing, for instance, just before the rear end of the paper sheet touches the second regulating guide 116. This operation is repeated. In step 208, it is judged whether or not the compiling of a predetermined number of sheets to be used for composing a sheet bundle is finished. If not finished, control returns to step 205. Conversely, if finished, stapling and discharging of the paper sheets are performed by the stapling mechanism portion 160 in step 209. Then, it is judged in step 210 whether or not a predetermined number of sheet bundles are produced. If not, control returns to step 201. Then, the aforementioned process is repeated. If finished, this sequence of the operations is completed.

Next, an operation of the longitudinal alignment assisting portion 120, which is a feature of this embodiment, is described in detail hereinbelow.

An operation of the longitudinal alignment assisting portion 120 that is in a first state in which the number of paper sheets stacked on the compiling tray 105 is equal to or less than a predetermined value (for example, 50) is explained by using FIGS. 11A and 11B. And, an operation of the longitudinal alignment assisting portion 120 that is in a second state in which the number of paper sheets stacked on the compiling tray 105 exceeds the predetermined value (for instance, 50) is explained by FIGS. 12A and 12B. FIGS. 11A and 12A illustrate the case that each of the sub-paddles 121 is placed at the top dead center (that is, the upper position or the retreating position). FIGS. 11B and 12B illustrate the case that each of the sub-paddles 121 is placed at the bottom dead center (that is, the lower position or the advancing position). This embodiment features that the upper position and the lower position of the sub-paddle 121 in the first state shown in FIGS. 11A and 11B differ from those of the sub-paddle 121 in the second state shown in FIGS. 12A and 12B, respectively. Incidentally, in these figures, T50 designates a height of 50 paper sheets stacked on the compiling tray 105 (or the shelf 171) and T100 denotes a height of 100 paper sheets stacked thereon. These heights are indicated by imaginary lines.

In the case that the number of paper sheets stacked on the compiling tray 105 is equal to or less than the predetermined value (for example, 50), when the next paper sheet is not newly supplied to the compiling tray 105, the sub-paddles 121 are at the upper position, and waits for the next supply of a paper sheet, as illustrated in FIG. 11A. Thereafter, when a new page sheet S is supplied to the compiling tray 105, a gear 127*b* is operated with predetermined timing, as illustrated in FIG. 11B. Then, each of the sub-paddles 121 is moved to the lower position. Subsequently, each of the sub-paddles 121 is moved to a position at which the sub-paddles 121 firmly abut against the surface of one of the paper sheets stacked on the compiling tray 105. Incidentally, the trajectory of movement of the sub-paddle 121 penetrates through the compiling tray 105. However, practically, the sub-paddle 121 is deformed by an elastic force, so that the trajectory goes along the surface of the paper sheet stacked on the compiling tray 105.

On the other hand, in the case that the number of paper sheets stacked in the compiling tray 105 exceeds the predetermined value, for instance, 50, the sub-paddle up/down solenoid 122 is sucked. Then, the sub-paddles 121 are brought into the second state illustrated in FIGS. 12A and 12B. During a state in which no paper is newly supplied to the compiling tray 105, each of the sub-paddles 121 is placed at the top dead center, as illustrated in FIG. 12A, and waits for the next supply of a paper sheet. Thereafter, when a new paper sheet S is supplied to the compiling tray 105, the gear 127*b* is operated with predetermined timing, and each of the sub-paddles 121 moves to the bottom dead center, as illustrated in FIG. 12B. Then, each of the sub-paddles 121 advances to a position at which the sub-paddles 121 securely abut against the surface of one of the paper sheets stacked on the compiling tray 105. Therefore, even in this case, similarly to the case that the number of paper sheets ranges from 1 to 50, the alignment of paper sheets already stacked on the compiling tray 105 can be prevented from being disturbed.

Thus, in the longitudinal alignment assisting portion 120, first, the gear 127*b* is turned one revolution at each supply of one paper sheet as a basic operation. Consequently, each of the sub-paddles 121 is moved between the upper position and the lower position. Each of the sub-paddles 121, which always rotate clockwise, performs this basic operation. Thus, when a new paper sheet S to be supplied to the compiling tray 105 is discharged (or supplied) from the conveying roller pair 104, a low conveyance force (substantially no conveyance force) is provided. When the paper sheet is discharged (or supplied) from the conveying roller pair 104 and then moved aside toward the wall portion 151*a* of the end wall 151 serving as the longitudinal reference wall, a high conveyance force can be provided. In other words, each of the sub-paddles 121, which always rotates clockwise as viewed in the figure, is located at the upper position, at which the supply of paper sheets is not hindered, when the paper sheets are discharged (or supplied) from the conveying roller pair 104 shown in FIG. 2. Further, when the paper sheets are discharged from the conveying roller pair 104 and moved side toward the longitudinal reference wall, the sub-paddles 121 can be moved to the lower position at which a necessary conveyance force can be provided. The sub-paddles 121 are controlled in such a way as to return to the upper position before the leading end of the next paper sheet reaches the positions of the sub-paddles 121. The sub-paddles 121, which are controlled in this way, can assist the compiling paddles 111 in conveying the paper sheets and in performing longitudinal alignment by pushing the rear end of each of the paper sheets against the longitudinal reference wall from the leading end side of each of the paper sheets. The assisting portion 120 functions in such a way as to reduce time required by the paper sheet to perform free fall onto the compiling tray 105. In other words, the assisting portion 120 functions in such a manner as to increase a compiling speed. Additionally, the sub-paddles 121 can prevent the paper sheets from moving too fast to stop and flying away to thereby deteriorate the quality of alignment.

As described above, the longitudinal alignment assisting portion 120 serving as a sheet putting-aside unit is configured in such a way as to be able to perform movement in a direction of thickness of a stacked paper bundle according to, for example, a thickness of the paper bundle as an applied operation in this embodiment. The assisting portion 120 is also configured so that the conveyance force for moving the paper sheets aside toward the wall portion 151*a* of the end wall 151 serving as the longitudinal reference wall is variable. That is, when the thickness of the paper bundle stacked on the compiling tray 105 is larger than a predetermined value, the sub-paddle up/down solenoid 122 is activated so that the entire sub-paddles 121 are lifted. In other words, the upper position and the lower position of each of the sub-paddles 121 are changed according to the thickness of the paper bundle. Consequently, when the longitudinal alignment assisting portion 120 performs a basic operation, a proper conveyance force can be provided during alignment of a paper bundle even in the case that the number of stacked paper sheets extremely increases.

Incidentally, sometimes, a special paper sheet other than ordinary paper sheets, for example, a paper sheet undergoing outward-three-folding performed by the folding function portion 50 shown in FIG. 1 (that is, a z-folded paper sheet) is supplied to the compiling tray 105. In the case that such a special paper sheet is supplied to the compiling tray 105, a conveyance force, whose magnitude is higher than an ordinary magnitude, is applied onto the paper sheet. That is, the compiling paddles 111 are provided at the rear end side (that is, the longitudinal reference wall side) position of the paper sheet so as to push the paper sheet against the end wall 151. The sub-paddles 121 are disposed at places closer to the leading end side (that is, nearly at the central portion) of the paper sheet from such a position. For instance, when a stapling operation is performed on an unfolded end part of a z-folded paper sheet, a z-folded part is present in the proximity of the place at which each of the sub-paddles 121 is located. In the case that a folded part is present, similarly to the z-folded paper sheet, the restoring force of the folded portion causes the paper sheet to be unfolded. Thus, the paper sheet is brought into a swelled state. Therefore, when such paper sheets are stacked on the compiling tray 105, a conveyance force, whose magnitude is higher than that of an ordinary force, of the sub-paddles 121 is provided.

Thus, according to this embodiment, in the case that outward-three-folded (that is, z-folded) paper sheets are supplied, and that it is necessary to maintain the paper conveyance force at a constant value, even when the number of the paper sheets is small, the longitudinal alignment assisting portion 120 is brought into the second state shown in FIGS. 12A and 12B, and continues to rotate by maintaining the state shown in FIG. 12A, though the basic operation due to the rotation of the second gear 127*b* is not performed. Consequently, the conveyance force applied to a z-folded paper sheet is prevented from being too much increased. Thus, the quality of alignment can be enhanced.

Figure 18:
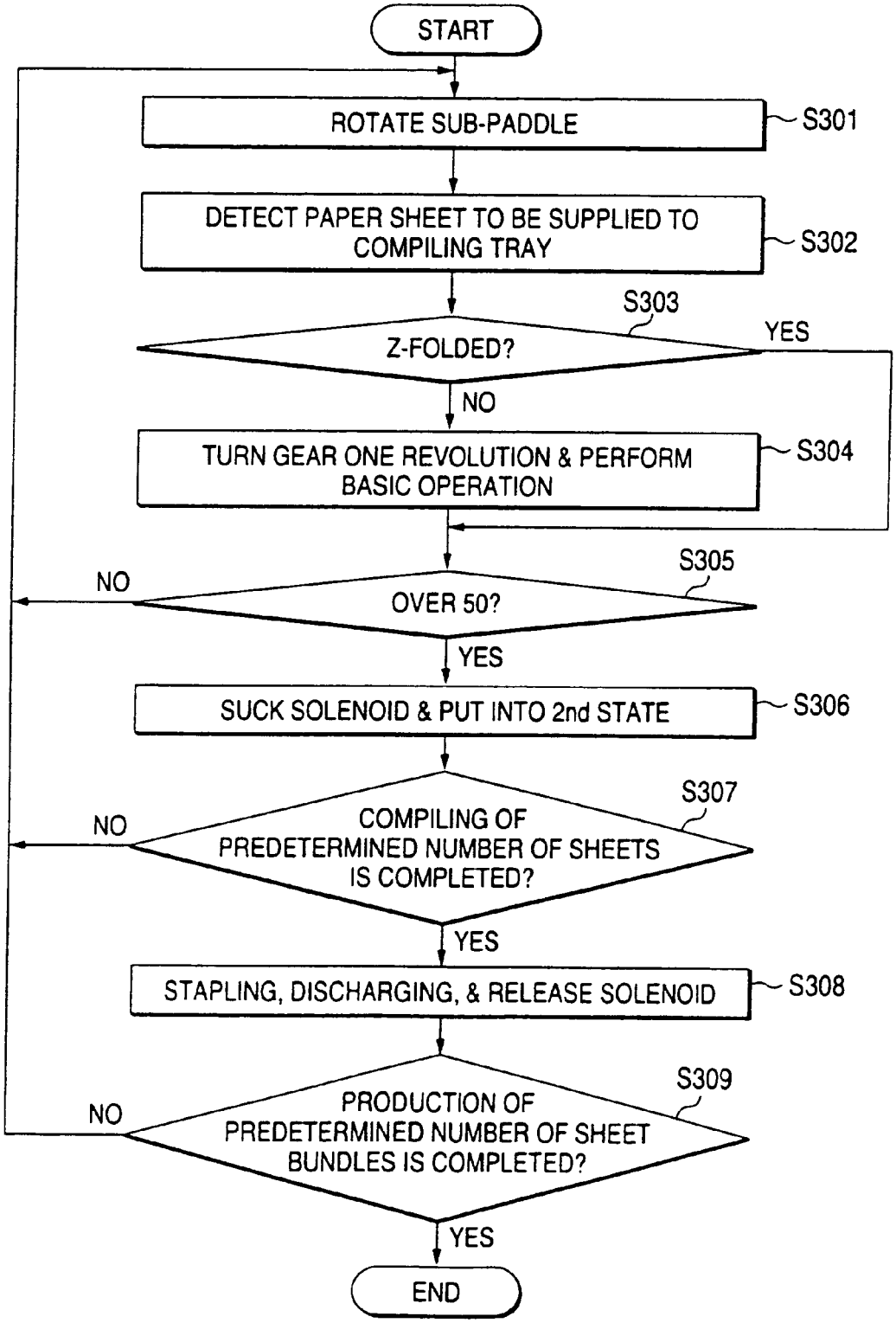
FIG. 18 is a flowchart illustrating a process performed in a controller.

FIG. 18 is a flowchart illustrating a process to be performed by the controller 7 so as to achieve the aforementioned functions. Hereinafter, description is given by centering on an operation of the longitudinal alignment assisting portion 120. When stapled brochures of the designated and predetermined number are produced, the controller 7 causes each of the sub-paddles 121 to rotate in step 301. Then, in step 302, the compile-exit sensor 103 detects a paper sheet to be supplied to the compiling tray 105. Subsequently, it is judged in step 303 whether or not the paper sheet is z-folded. In the case that the paper sheet is not z-folded, the controller 7 causes the second gear 172*b* to rotate one revolution with predetermined timing with which a paper sheet is supplied to the compiling tray 105. Thus, in step 304, a basic operation of making the sub-paddles 121 to reciprocate between the upper position and the lower position is performed. In the case that the paper sheet to be supplied is z-folded, control bypasses step 304 and advances to step 305.

The controller 7 counts paper sheets supplied to the compiling tray 105 according to signals outputted from the compile-eject sensor 103. It is judged in step 305 whether or not the number of paper sheets supplied to the compiling tray 105 exceeds the predetermined value, for instance, 50. When being equal to or less than 50, a process from step 302 is repeated. When exceeding 50, the conveyance force is reduced. Further, the sub-paddle up/down solenoid 122 is sucked. Then, the paddles are brought into the second state, and the upper position and the lower position are raised together in step 306. Incidentally, the controller 7 can recognize the presence of a z-folded paper sheet and the supply of a special paper sheet by cognizing outputs from the folding function portion 50 and an interleaving-paper function portion 80, and by detecting a paper supply portion (not shown) and paper supply places of an image forming apparatus 1, and by cognizing a preset mode having been set in the image forming apparatus 1.

Thereafter, the controller 7 judges in step 307 whether or not the compiling of a predetermined number of paper sheets is finished. If not reach the predetermined value, control returns to step 302. If a predetermined number of paper sheets are compiled, the stapling processing, the discharging, and the release of the solenoid are performed in step 308. Then, it is judged in step 309 whether or not the production of the predetermined number of sheet bundles is completed. If not completed, control returns to step 302. Then, the aforementioned process is repeated. If completed, a sequence of processes is terminated.

Incidentally, the aforementioned embodiment is configured so that when z-folded paper sheets are conveyed, the paddles are brought into the second state when the predetermined number of paper sheets, that is, 50 sheets are supplied. Preferably, the counting of 50 sheets is performed by counting 5 at each supply of paper sheets, for example, when z-folded paper sheets are supplied to the compiling tray 105. The reason is described in the following description. That is, each of the sub-paddles 121 serving as second putting-aside unit is disposed at a place closer to the leading end of the paper sheet than the place at which the compiling paddles 111 are located. When the folded parts of the z-folded paper sheets are conveyed to the leading end of the paper sheet and the rear ends of the paper sheets are stapled, the sub-paddles 121 abut against a part in the vicinity of the central folded part. Therefore, during an operation of the sub-paddles 121, an appropriate conveyance force cannot be provided when the value corresponding to one count is equal to the number of paper sheets each having no folded parts. Similarly, for example, when extremely thick paper sheets are provided as compared with an ordinary paper sheet, the count can be performed by counting 2 at each supply of a paper sheet. Incidentally, when it is necessary to count the supplied paper sheets in addition to the change of the state of the paddles 121, the count can be performed under similar control.

Next, a description is given of a case where paper sheets and thick paper sheets having undergone predetermined post-processing are supplied to and stacked on the compiling tray 105.

Figure 19:
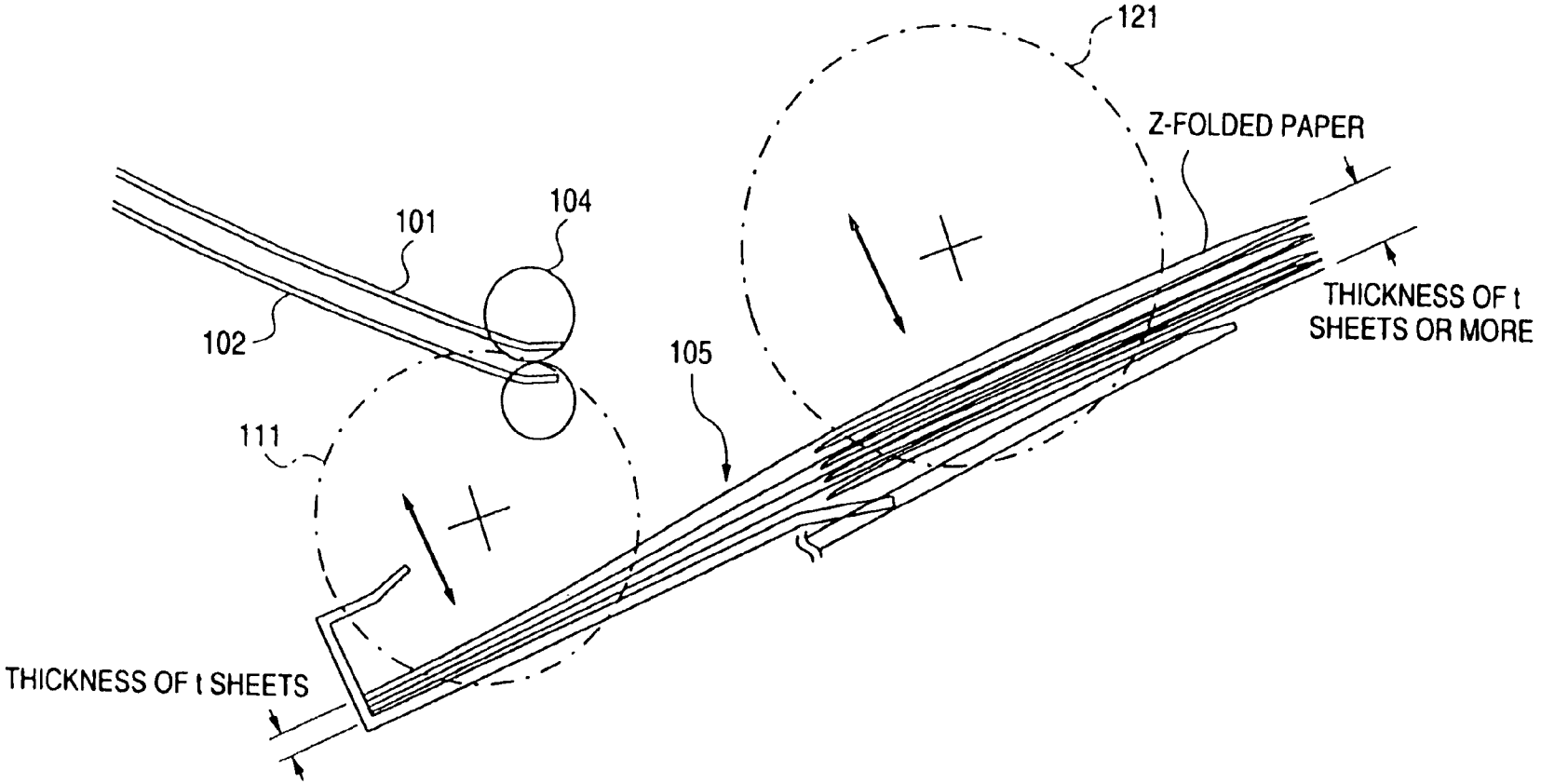
FIG. 19 is an explanatory view illustrating a state in which paper sheets having under gone z-folding (that is, z-folded paper sheets) are stacked on a compiling tray.

FIG. 19 is an explanatory view illustrating a state in which paper sheets having undergone outward-three-folding (or z-folding), that is, z-folded paper sheets are stacked on the compiling tray 105. As described above, in the sheet processing apparatus 2, for example, the stackable number of paper sheets, such as 100, is usually set as the sheet stacking capacity of the compiling tray 105. For instance, the up/down motions of the compiling paddles 111 and the sub-paddles 121 are performed according to the count of sheets stacked on the compiling tray 105. However, in the case that paper sheets having undergone some post-processing, for example, z-folded paper sheets are supplied to the compiling tray 105, a folded part thereof largely differs in thickness from a part having undergone no folding. In the case of compiling z-folded paper sheets, as illustrated in FIG. 19, even when the rear end side (that is, a left-hand side, as viewed in this figure) portion of the paper bundle has a total thickness of t sheets, the discharging side (that is, a right-hand side portion thereof has a thickness oft sheets or more.

For example, as described above with reference to FIGS. 15A to 17, the compiling paddles 111 and the regulating members, that is, the first regulating guide 115 and the second regulating guide 116 of the longitudinal alignment portion 110 are controlled by the controller 7 in such a way as to be lifted when 50 sheets are counted. As described above with reference to FIGS. 11A to 12B and 18, the sub-paddles 121 of the longitudinal alignment assisting portion 120 are controlled by the controller 7 in such a way as to be put into the second state when a sheet count is 50. However, in the case that, for instance, z-folded paper sheets are supplied to the compiling tray 105, the thickness of the paper bundle at the acting position of the longitudinal alignment portion 110 (that is, the up/down position of each of the compiling paddles 111) largely differs from that thereof at the acting position of the longitudinal alignment assisting portion 120 (that is, the up/down position of each of the sub-addles 121), as illustrated in FIG. 19. In this embodiment, the place, at which the sub-paddle 121 serving as the second moving-aside unit is disposed, is closer to the leading end side of the paper sheet than the place at which the compiling paddle 111 serving as the first moving-aside unit is disposed. However, in the case that the z-folded paper sheets are supplied to the compiling tray 105, that the folded part of each of the z-folded paper sheets is conveyed as a leading end side part thereof, and that a rear end side part thereof is stapled, the sub-paddle 121 abuts against a part located in the vicinity of a central folded part thereof. Therefore, in the case that a z-folded-sheet count, at which the sub-paddle 121 is brought into the second state during the motion thereof, is equal to the foldless-sheet count, at which the sub-paddle 121 is put into the second state, a proper conveyance force cannot be provided.

Thus, this embodiment is adapted so that when paper sheets supplied to the compiling tray 105 are subjected to some post-processing, such as folding and punching, the sheet count is converted according to the kind of the post-processing, that is, one sheet count is converted into n counts (incidentally, "n" is a number that is greater than 1) according thereto, and that a predetermined control operation is performed according to a converted sheet count. Similarly, this embodiment is adapted so that when paper sheets supplied to the compiling tray 105 are special ones, such as cardboards, the sheet count is converted according to the kind of the special paper sheets, that is, one sheet count is converted into n counts (incidentally, n>1) according thereto, and that a predetermined control operation is performed according to a converted sheet count. The predetermined control operation is, for example, to change the stackable number of paper sheets on the compiling tray 105, and to control the up/down motions of the compiling paddles 111 and the sub-paddles 121.

Incidentally, in the case of ordinary paper sheets, for instance, black/white plain paper has weighing capacity of about 65 gsm to 80 gsm (gram/square meter ($g/m^2$)). For instance, ordinary paper for color printing has weighing capacity of about 90 gsm. The stackable number of sheets on the compiling tray 105, that is, the upper limit of the number of paper sheets stacked thereon can be preset to be about 100 when paper having weighing capacity of 80 gsm is employed as the basis therefor. The up/down motions of the compiling paddles 111 and the sub-paddles 121 are carried out after counting a predetermined number of sheets selected by employing the paper having weighing capacity of 80 gsm as the basis. On the other hand, for instance, paper having weighing capacity of about 120 gsm to 128 gsm or more may fall under the category of the cardboard. In the case of some sheet processing apparatus 2, for example, a cardboard having weighing capacity of about 280 gsm can be supplied to the compiling tray 105.

It is often that the stackable number of sheets on the compiling tray 105 is preliminarily indicated to users as a specification limit value of the sheet processing apparatus 2. For example, in the case that paper sheets having undergone outward-three-folding (that is, z-folding) or cardboards are stacked, a value obtained by reducing the stackable number according to the stacking conditions can be preliminarily indicated to users as the stackable number of sheets. That is, the stackable number of sheets is determined by changing the value of "n" according to the conditions for stacking the sheets, for example, whether or not post-processing is applied to the sheets to be stacked.

Figure 20:
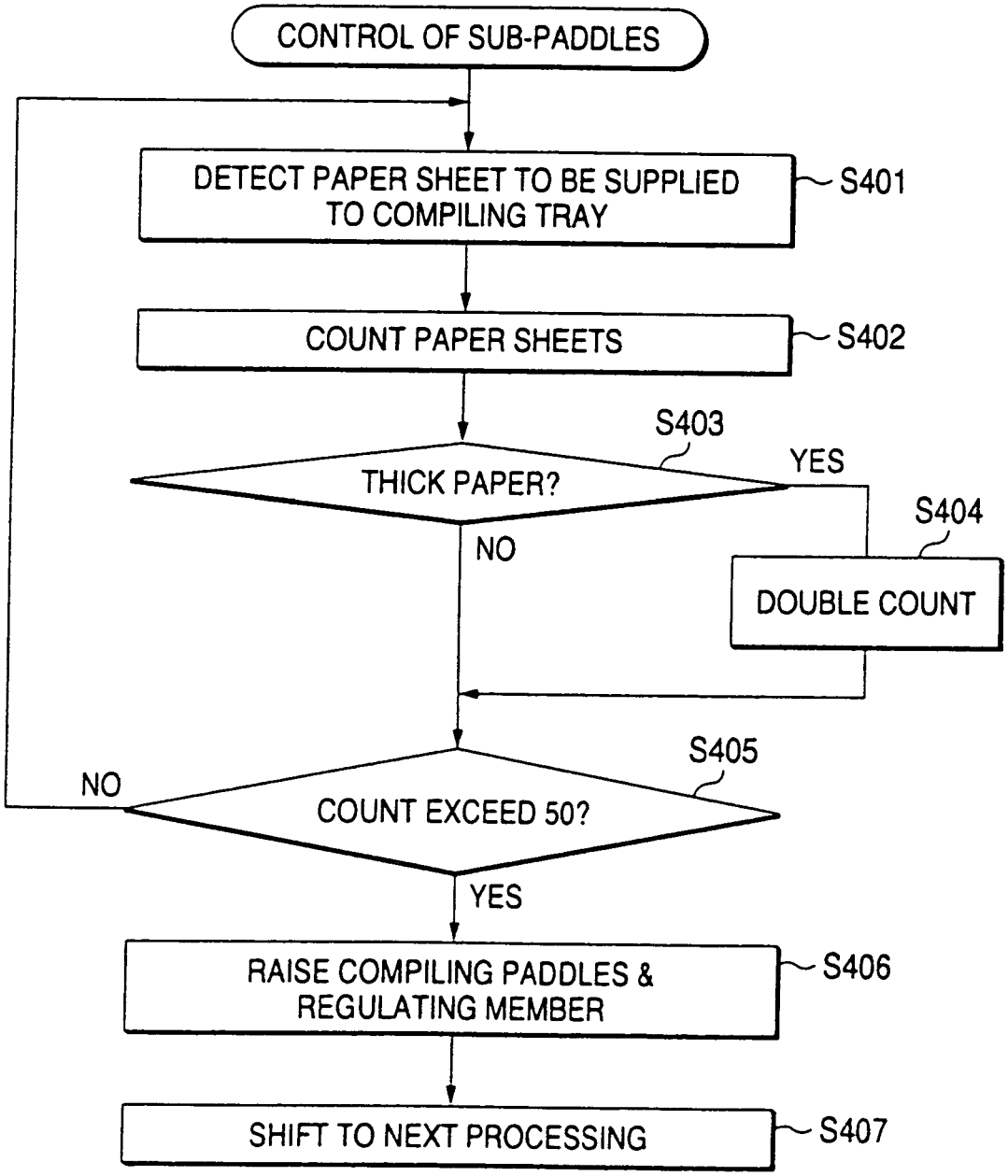
FIG. 20 is a flowchart illustrating the count correcting function for controlling compiling paddles (that is, the longitudinal alignment portion), which is performed by a controller.

FIG. 20 is a flowchart illustrating a process of performing the function of correcting a count for controlling the compiling paddle 111 (thus, the longitudinal alignment portion 110), which is performed in the controller 7. In this process, first, a paper sheet to be supplied to the compiling tray 105 is detected according to signals outputted from the compile-exit sensor 103 in step 401. The controller 7 counts paper sheets according to the signals outputted from the compile-exit sensor 103 in step 402. At that time, in the case of employing the buffer compiling method as described above, a first detected sheet is counted as 2 sheets.

Then, in step 403, the controller 7 judges whether or not the paper sheet to be supplied is a cardboard. In this step, in the case that the paper sheet is supplied from a place, such as a predetermined paper feed tray and an interposer 6 (see FIG. 1), in which cardboards are preliminarily accommodated, the paper sheet to be supplied is judged to be a cardboard. Alternatively, when a user designates the paper sheet as a cardboard, the controller 7 also judges that the paper sheet to be supplied is a cardboard. Alternatively, the controller 7 may be adapted to judge from a result of detection performed by a thickness detection sensor (not shown) provided at a predetermined place on the paper conveying path that the paper sheet to be supplied is a cardboard. When the controller 7 judges that the paper sheet to be supplied is a cardboard, the value of a count corresponding to the paper sheet to be supplied is increased "n" times (for example, twice) in step 404. Then, the controller 7 advances to step 405. In the case that the thickness of the paper sheet is extremely thin, according to the kind (or the thickness) of the paper sheet, the value of "n" can be set according to the kind (or the thickness) of the paper sheet at 3, 4, and so on. Needless to say, in addition to natural numbers, which are equal to or more than 2, a given number, which is larger than 1 and includes a decimal number, can be selected as the value of a multiple "n". If it is decided in step 403 that the paper sheet to be supplied is not a cardboard, the count is not corrected.

Thereafter, the controller 7 adds up such numbers and judges in step 405 whether or not the value of the count (or a total number of paper sheets) exceeds a predetermined value, for example, 50. If not exceed 50, control returns to step 401. Then, the aforementioned process is repeated. If exceeds 50, the compiling paddles 111 and the regulating members, that is, the first regulating guide 115 and the second regulating guide 116 are lifted in step 406. Then, control proceeds to the next process.

Figure 21:
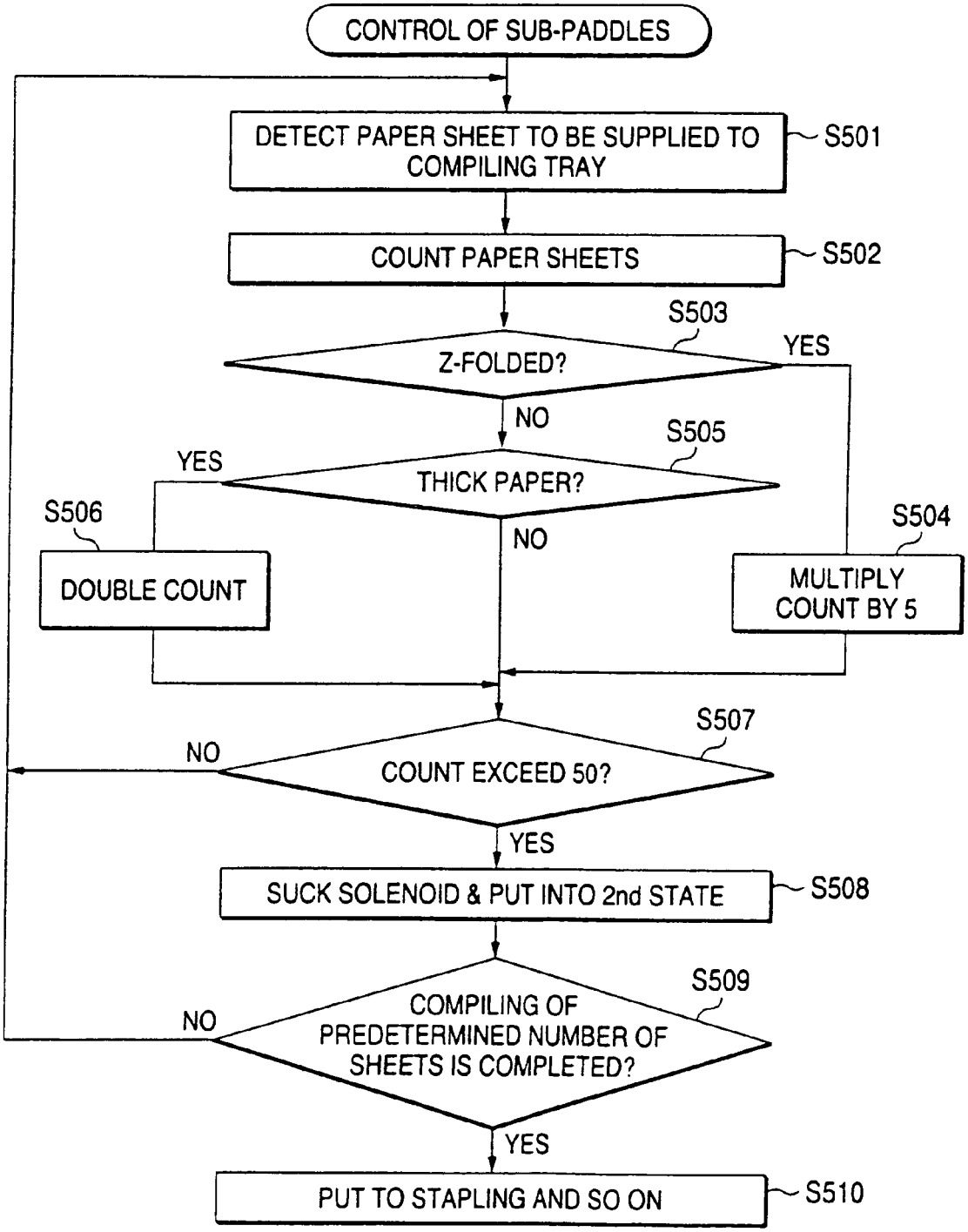
FIG. 21 is a flowchart illustrating the count correcting function for controlling sub-paddles (that is, the longitudinal alignment assisting portion), which is performed by the controller.

FIG. 21 is a flowchart illustrating a process of performing the function of correcting a count for controlling the sub-paddle 121 (thus, the longitudinal alignment assisting portion 120), which is performed in the controller 7. Similarly to the case illustrated in FIG. 20, first, a paper sheet to be supplied to the compiling tray 105 is detected according to signals outputted from the compile-exit sensor 103 in step 501. Then, the controller 7 counts paper sheets according to the signals outputted from the compile-exit sensor 103 in step 502. In the case of employing the buffer compiling method, a first detected sheet is counted as 2 sheets.

Then, in step 503, the controller 7 judges whether or not outward three-folding (that is, z-folding) is performed on the paper sheet to be supplied. If so, the value of a count corresponding to the paper sheet to be supplied is increased "n" times (for instance, five times) in step 504. Subsequently, the control operation 7 advances to step 507. If not, the controller 7 judges in step 505 whether or not the paper sheet to be supplied is a cardboard. If so, the value of a count corresponding to the paper sheet to be supplied is increased "n" times (for example, twice) in step 506. If not, the count is not changed. Then, the value of the count is added to the accumulated value thereof. Subsequently, the controller 7 judges in step 507 whether or not the resultant value of the count exceeds 50. If not, the controller 7 returns to step 501. If exceeds 50, the sub-paddle up/down solenoid 122 is sucked. Then, the sub-paddles 121 are brought into the second state in step 508. Subsequently, the controller 7 judges in step 509 whether or not the compiling of a predetermined number of paper sheets is finished. If not, the process starting at step 501 is repeated. If finished, the controller 7 proceeds to a stapling process. Incidentally, in the case that one sheet is counted as n sheets, the value of "n" can be a number that includes a decimal number and is set to be larger 1.

Incidentally, when the count is converted in the case of paper sheets having undergone the outward-three-folding (that is, z-folding), the controller 7 can perform additional fine control operations. For example, in the case that a paper sheet having under gone the outward three-folding (that is, z-folding) is present in a lower part of a paper bundle stacked on the compiling tray 105 (that is, such a paper sheet is compiled at a lower part), the repulsive force of a folded part of the paper sheet having undergone the outward-three-folding (or z-folding) is reduced owing to the weight of paper sheets stacked later thereon. Thus, the value of "n" for conversion of the count can be set to be a small value. Conversely, in the case that a paper sheet having undergone the outward three-folding (that is, z-folding) is compiled at an upper part (that is, a top-surface-side part of a paper bundle), the repulsive force of the folded part becomes large. Thus, it is expected that the paper bundle is largely swelled. Therefore, it is preferable that the value of "n" is set at a large value.

In the case that the paper sheet having undergone the outward-three-folding (that is, z-folding) is a cardboard, this processing apparatus can be modified so that it is judged from the resultant accumulated value of the in step 507 shown in FIG. 21 whether or not the accumulated value of the count exceeds 50. When the outward-three-folding (that is, z-folding) is performed on a cardboard by a certain folding function portion 50, the paper sheet may be largely swelled. This modification is effective in the case that the paper sheet having undergone the outward-three-folding (that is, z-folding) is supplied from such a folding function portion 50. In such a case, the quality of alignment of paper sheets and the usability of the processing apparatus can be enhanced still more by making the values of the multiple "n" differing from each other, which are respectively used in the cases that page sheets each having undergone the outward-three-folding (that is, z-folding) are supplied, and that cardboards having undergone no folding are supplied. For example, between the cases of supplying plain paper sheets, and of supplying cardboards, the value of "n" can be set in such a way as to differ from each other as follows:

(The value of "n" in the case of supplying z-folded plain paper sheets):(the value of "n" in the case of supplying z-folded cardboards)=1:1.5, (The value of "n" in the case of supplying plain paper sheets having no folded parts):(the value of "n" in the case of supplying cardboard having no folded parts)=1:2.

As described in detail above, according to this embodiment, when the alignment of paper sheets on the compiling tray 105 is performed, a proper conveyance force can stably be provided to paper sheets to be supplied, according to the thickness of a paper bundle (or a sheet bundle). Even a large amount of a paper bundle can orderly be aligned. Higher quality of alignment of paper sheets can be realized by a sheet processing apparatus having the first regulating guide 115, which operates in synchronization with the alignment o at a rotational speed that is variable according to the speed of the alignment. Moreover, the sheet processing apparatus is provided with the second regulating guide 116 that is placed in the neighborhood of the longitudinal reference wall and/or extends to the position of the longitudinal reference wall. Thus, the influence of curled and swelled parts formed on the rear end (that is, the longitudinal reference wall side end) of each of the paper sheets can be suppressed. Consequently, the quality of alignment of paper sheets can be enhanced still more.

Further, according to this embodiment, when alignment of paper sheets stacked on the compiling tray 105, a proper conveyance force determined according to the thickness of a paper bundle (or a sheet bundle) can stably be provided to the paper sheets to be supplied to the tray 105. Thus, even in the case of a large amount of a paper bundle, the alignment of paper sheets can orderly be achieved. Even when high-speed compiling of paper sheets is needed, time required for alignment of paper sheets can dramatically be decreased by assisting the alignment. Even when z-folded paper sheets and extremely thick paper sheets are compiled, high quality of alignment can be maintained by providing an appropriate conveyance force.

As described in detail above, in this embodiment, one paper sheet is counted as n-sheets according to the conditions of the post-processing applied on paper sheets and to the thickness of the paper sheets. Then, each of the constituent members is controlled according to the converted value of the count. This embodiment is constituted so that the stackable number of paper sheets, which is the upper limit of the number of paper sheets stacked on the compiling tray 105, can be changed according to the converted value of the count, which is obtained by counting one paper sheet as n-sheets. Consequently, finer control of motions and indications is enabled according to the number of sheets stacked thereon. This finer control operation enhances the quality of alignment of paper sheets and the usability of the sheet processing apparatus.

As illustrated in FIGS. 20 and 21, in the case that the paper bundle stacked on the compiling tray 105 includes a paper sheet, which has undergone outward-three-fitting (that is, z-folding) and also has folded parts, the number of stacked sheets is counted through conversion using the value of "n", which is used for controlling an operation of a member, such as the sub-paddle 121, acting upon overlapped parts of the paper sheet, which are caused by folding. On the other hand, there is no necessity for correcting the count of paper sheets so as to control an operation of a member, such as the compiling paddle 111, acting upon non-overlapped parts of the paper sheet, which are caused by folding. Thus, according to the invention, the value of the count can be corrected in consideration of not only the conditions of the paper sheets stacked on the compiling tray 105 but the conditions of the members acting upon the paper sheets stacked thereon. Consequently, each of the members is enabled to perform an operation according to the substantial stackable number of sheets, so that the alignment of paper sheets and the stacking thereof can be more orderly achieved.

Incidentally, the condition of the member acting upon the stacked paper sheets may change according to the size of stacked paper sheets. For instance, the positions of folded parts in the case of applying what is called outward-three-folding (that is, z-folding) on a paper sheet, whose paper size is what is called "A3 longitudinal" (420 mm), differs from those of folded parts in the case of applying the outward-three-folding (that is, z-folding) on a paper sheet, whose paper size is what is called "B4 longitudinal" (364 mm). Thus, the conditions of the member acting thereon may largely change between these cases. Therefore, it is effective in obtaining the advantages to set the value of "n" at different values according to the paper sizes of the sheet having folded parts.

Second Embodiment

Figure 13:
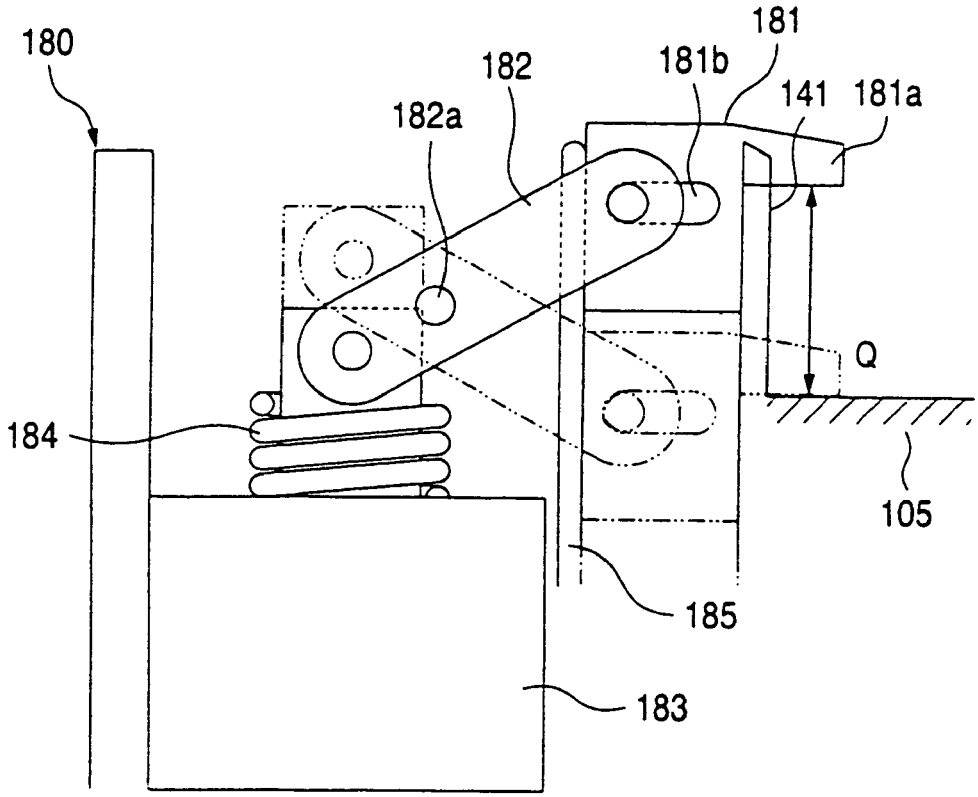
FIG. 13 is an explanatory view illustrating each of mechanisms of a paper bundle grasping portion of a second embodiment.

Although this embodiment is similar to the first embodiment, paper sheets already stacked on the compiling tray 105 are held by using a paper bundle grasping portion 180 shown in FIG. 13, instead of the sub-paddle 121. Incidentally, in the second embodiment, constituent elements, which are the same as those of the first embodiment, are designated by same reference characters. The description of such constituent elements is omitted herein.

The paper bundle grasping portion 180 is provided in a side portion of a compiling tray 105 in the neighborhood of a transversal reference wall (not shown) placed on the front side of the processing apparatus. The paper bundle grasping portion 180 includes a lever 181, which has a claw 181*a* provided in such a way as to be able to advance to and retract from the compiling tray 105, and also includes a link 182, which swings around a shaft 182*a* and has an end mounted in an elongated hole 181*b* and also has the other end attached to a lever up/down solenoid 183, and further includes a spring 184 attached to the lever up/down solenoid 183, and a guide 185 for guiding the lever 181 in an upward-downward direction.

The paper bundle grasping portion 180 can raise the lever 181 to an upper limit position (that is, a retracting position) through a link 182 by attracting the lever up/down solenoid 183. Incidentally, when the attraction of the lever up/down solenoid 183 is ceased, the link 182 is moved by a pushing force of the spring 184 to a position indicated by double-dashed-chain lines in this figure. Thus, the lever 181 can be moved downwardly to a lower limit position (that is, an advancing position). That is, the lever 181 performs up-and-down motions within a range Q. Incidentally, this embodiment is adapted so that even when 100 sheets are stacked on the compiling tray 105, the sheets do not touch the lever 181.

When a new paper sheet is supplied to the compiling tray 105, the lever 181 moves toward the lower limit position, that is, advances to a position at which the lever 181 touches the paper sheets stacked on the compiling tray 105. Incidentally, the lever 181 stops at a distance, which is determined according to the number (or thickness) of paper sheets stacked on the compiling tray 105, from the lower limit position. The lever 181 moves to the lower-limit-position side before the leading edge of a new paper sheet supplied to the compiling tray 105 touches the paper sheets already stacked thereon. Then, the lever 181 presses down the stacked paper sheets. Thus, the lever 181 prevents the new sheet S from hitting the alignment of the paper sheets stacked on the compiling tray 105 to thereby disturb the alignment thereof. Especially, in this embodiment, the paper sheets already stacked on the compiling tray 105 are firmly grasped between the lever 181 and the compiling tray 105. Consequently, the alignment of the sheets can be more effectively prevented from being disturbed. The lever 181 is adapted to go away from the paper sheets before the rear edge of the new sheet S drops onto the compiling tray 105. Thus, this new sheet S and the paper sheets are not prevented from being aligned on the compiling tray 105.

Therefore, this embodiment, which is provided with the paper bundle grasping portion 180, can prevent the alignment of paper sheets already stacked on the compiling tray 105 from being disturbed by a paper sheet newly supplied thereto.

As described above, according to the invention, sheet bundles, which have already been aligned on a compiling tray, from being disturbed by a sheet newly supplied onto the compiling tray.

Further, according to the invention, even when sheet bundles have different thicknesses, respectively, an appropriate conveyance force can stably provided. Moreover, sheet alignment accuracy can be enhanced Further, according to the invention, even when the thicknesses of sheet bundles differ from one another, a proper conveyance force can stably be provided thereto. Sheet alignment accuracy can be enhanced.

Further, according to the invention, good quality of alignment of paper sheets can be ensured even when thick paper sheets or folded paper sheets are supplied.

What is claimed is:

1. A sheet bundle aligning method for forming a sheet bundle by aligning end portions, in a conveying direction, of sheets supplied to a compiling tray, on which the conveyed sheets are stacked, the method comprising:

counting sheets supplied to said compiling tray, the sheets having undergone a predetermined post-processing, which is a sheet folding processing;

correcting the number of said counted sheets based on said process performed for the sheets supplied to the compiling tray;

pushing a rotary member against a surface of a sheet in synchronization with said sheet, and conveying said sheet to a reference wall for aligning the end portions, in the conveying direction, of the plurality of sheets;

changing a conveyance force of said rotary member according to the corrected number of sheets; and changing a position of a regulating guide by following a change of a reference position of the rotary member according to the corrected number of sheets, wherein the reference position of the rotary member is in the direction of thickness of the sheet, and the regulating guide regulates a position of said rotary member in said direction of thickness of a sheet by contacting with said sheets.

2. The sheet bundle alignment method according to claim 1, wherein the conveyance force is changed by changing a distance of said rotary member from a sheet stacking surface of said compiling tray.

3. The sheet-bundle alignment method according to claim 1, the method further comprising:

assisting the sheet alignment performed by a longitudinal alignment unit.

4. The sheet-bundle alignment method according to claim 1, the method further comprising performing correction at said sheet folding processing.

* * * * *